US010915050B2

(12) United States Patent
Haruyama

(10) Patent No.: US 10,915,050 B2
(45) Date of Patent: Feb. 9, 2021

(54) FIXING DEVICE AND IMAGE FORMING APPARATUS WITH OPPOSING ROTATING MEMBERS AND BELT

(71) Applicant: Oki Data Corporation, Tokyo (JP)

(72) Inventor: Masahiro Haruyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/853,645

(22) Filed: Apr. 20, 2020

(65) Prior Publication Data

US 2020/0341420 A1 Oct. 29, 2020

(30) Foreign Application Priority Data

Apr. 26, 2019 (JP) ..... 2019-086004

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2032; G03G 15/2053
USPC ..... 399/122, 329
See application file for complete search history.

(56) References Cited

U.S. PATENT DOCUMENTS 10,216,128 B2 * 2/2019 Haruyama ..... G03G 15/2053

FOREIGN PATENT DOCUMENTS

| | | | |
|---|---|---|---|
| JP | 2009229833 | A | 10/2009 |
| JP | 2014044364 | A | 3/2014 |
| JP | 2015001561 | A | 1/2015 |
| WO | 2019013445 | A1 | 1/2019 |

* cited by examiner

*Primary Examiner* — William J Royer
(74) *Attorney, Agent, or Firm* — Rabin & Berdo, P.C.

(57) ABSTRACT

A fixing device includes a first rotation section and a second rotation section. The first rotation section includes a first rotating member and a first belt. The first rotating member is rotatable about a first rotational axis. The first belt is caused to rotate by rotation of the first rotating member. The second rotation section includes a second rotating member. The second rotation section is opposed to the first rotation section in a first direction and allows a medium to be sandwiched between the first rotation section and the second rotation section. The second rotating member is rotatable about a second rotational axis. The second rotation section is disposed allowing an angle of the second rotational axis with respect to the first rotational axis viewed from the first direction to be variable.

12 Claims, 24 Drawing Sheets

FIXING DEVICE AND IMAGE FORMING APPARATUS WITH OPPOSING ROTATING MEMBERS AND BELT

CROSS REFERENCE TO RELATED APPLICATIONS

The present application claims priority from Japanese Patent Application No. 2019-086004 filed on Apr. 26, 2019, the entire contents of which are hereby incorporated by reference.

BACKGROUND

The technology relates to a fixing device and an image forming apparatus provided with the fixing device.

A fixing device that fixes a developer image to a medium with use of a belt and an image forming apparatus provided with the fixing device have been proposed, for example, as disclosed in Japanese Unexamined Patent Application Publication No. 2015-001561.

SUMMARY

In an image forming apparatus provided with a fixing device that fixes a developer image to a medium with use of a belt, for example, performing fixing operation while stably applying heat and pressure on the medium by means of the belt may allow for high-quality image formation.

It is desirable to provide a fixing device and an image forming apparatus that are suitable to provide a high-quality image for a longer period.

According to one embodiment of the technology, there is provided a fixing device that includes a first rotation section and a second rotation section. The first rotation section includes a first rotating member and a first belt. The first rotating member is rotatable about a first rotational axis. The first belt is caused to rotate by rotation of the first rotating member. The second rotation section includes a second rotating member. The second rotation section is opposed to the first rotation section in a first direction and allows a medium to be sandwiched between the first rotation section and the second rotation section. The second rotating member is rotatable about a second rotational axis. The second rotation section is disposed allowing an angle of the second rotational axis with respect to the first rotational axis viewed from the first direction to be variable.

According to one embodiment of the technology, there is provided an image forming apparatus that includes a fixing device. The fixing device includes a first rotation section and a second rotation section. The first rotation section includes a first rotating member and a first belt. The first rotating member is rotatable about a first rotational axis. The first belt is caused to rotate by rotation of the first rotating member. The second rotation section includes a second rotating member. The second rotation section is opposed to the first rotation section in a first direction and allows a medium to be sandwiched between the first rotation section and the second rotation section. The second rotating member is rotatable about a second rotational axis. The second rotation section is disposed allowing an angle of the second rotational axis with respect to the first rotational axis viewed from the first direction to be variable.

In the fixing device and the image forming apparatus according to one embodiment of the technology, adjustment of the angle of the second rotational axis with respect to the first rotational axis suppresses the movement of the first belt along the first rotational axis accompanying the rotation of the first rotating member.

DETAILED DESCRIPTION

Figure 1A:
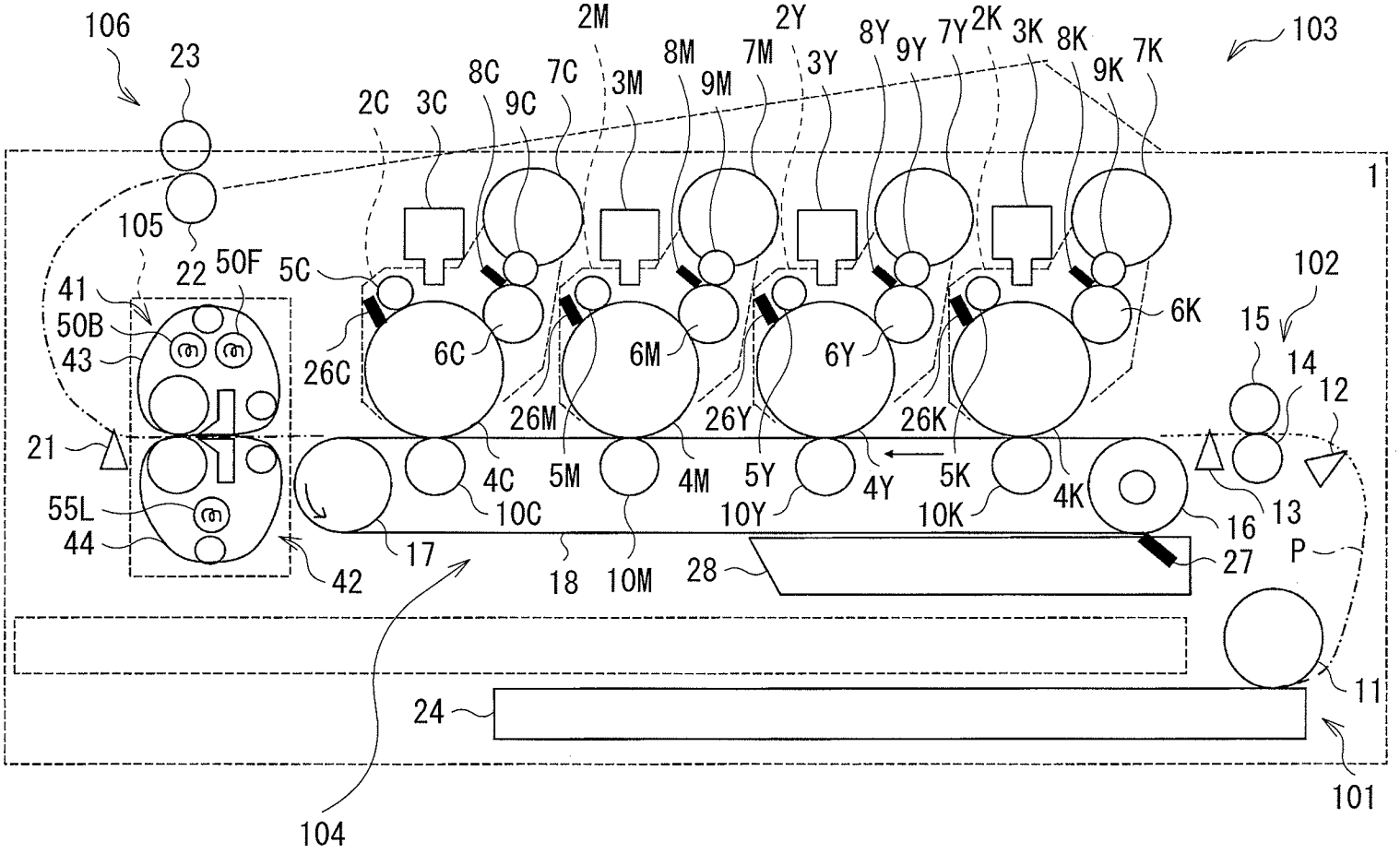
FIG. 1A is a schematic diagram illustrating an example of an overall configuration of an image forming apparatus according to an example embodiment of the technology.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail.

1. Example Embodiments

[Outline Configuration of Image Forming Apparatus 1]

Figure 1B:
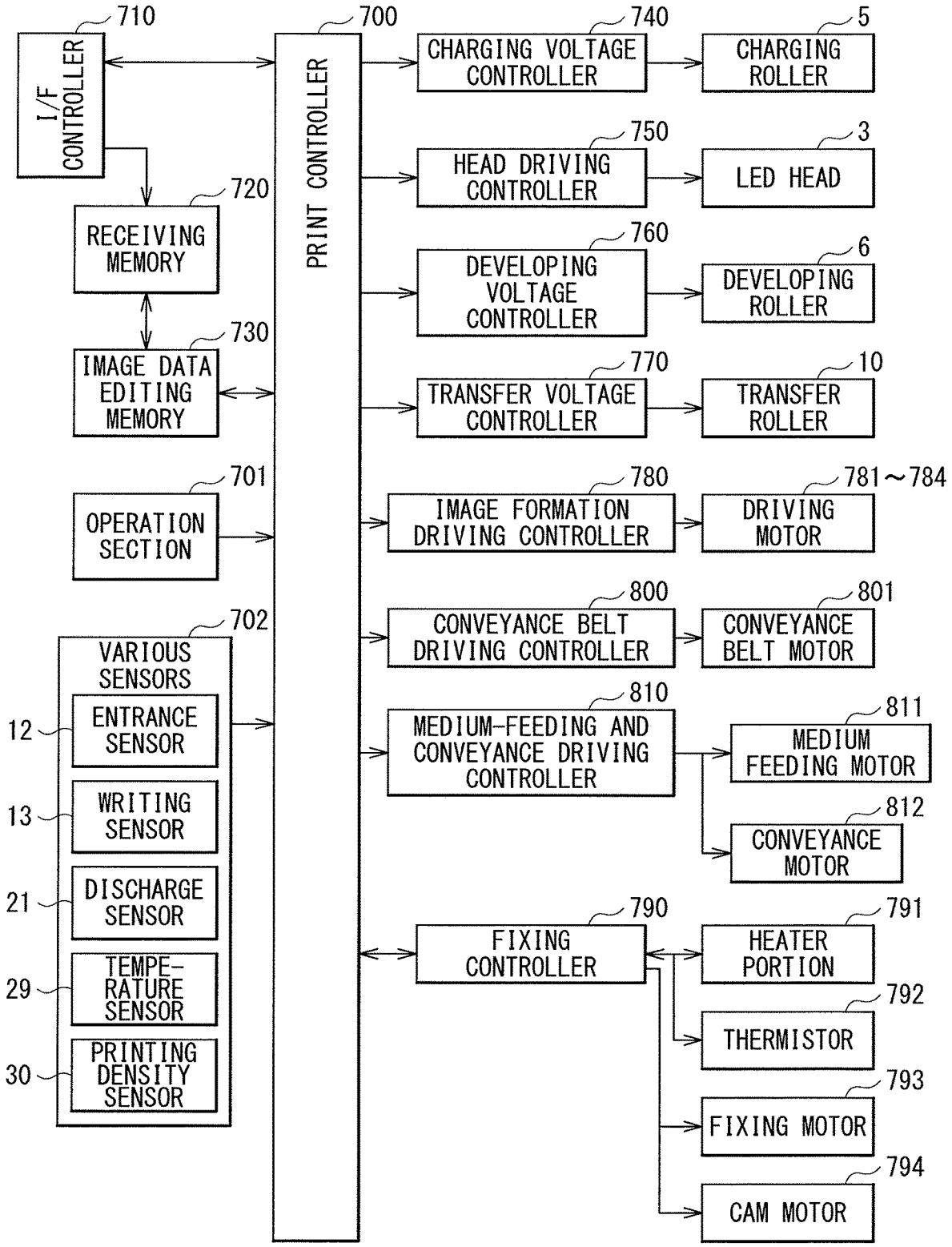
FIG. 1B is a block diagram schematically illustrating an example of an internal configuration of an image forming apparatus illustrated in FIG. 1A.

FIG. 1A schematically illustrates an example of an overall configuration of an image forming apparatus 1 that is provided with a fixing device 105 according to an example embodiment of the technology. The fixing device 105 may serve as a belt section. FIG. 1B is a block diagram corresponding to an example of an internal configuration of the image forming apparatus 1 illustrated in FIG. 1A. The image forming apparatus 1 may be an electrophotographic printer that forms an image on a medium, for example. The medium may be also referred to as a print medium or a transfer material. Non-limiting examples of the image may include a color image. Non-limiting examples of the medium may include a sheet of paper and any type of film. Herein, a direction perpendicular to a conveyance direction of the medium is referred to as a width direction. In FIG. 1A, the width direction is an X-axis direction perpendicular to a paper plane of FIG. 1A. A direction in which the medium is conveyed inside the fixing device 105 is referred to as a Z-axis direction, and a height direction perpendicular to both the X-axis direction and the Z-axis direction is referred to as a Y-axis direction, as will be described later.

The image forming apparatus 1 may include, for example but not limited to, a medium feeding section 101, a medium conveying section 102, an image forming section 103, a transfer section 104, the fixing device 105, and a discharging section 106, for example, in a housing.

[Medium Feeding Section 101]

The medium feeding section 101 may include, for example but not limited to, a medium cassette 24 and a medium feeding roller 11. The medium cassette 24 may serve as a medium feeding tray and may contain the media. The medium feeding roller 11 may take out the media one by one from the medium cassette 24 and feed each of the media to the medium conveying section 102.

[Medium Conveying Section 102]

The medium conveying section 102 may include, for example but not limited to, an entrance sensor 12, a conveying roller 14, a conveying roller 15, and a writing sensor 13, for example, in order from upstream. The entrance sensor 12 and the writing sensor 13 may each detect a position of the medium traveling along a conveyance path P. The conveying roller 14 and the conveying roller 15 may be paired with each other and be opposed to each other. The pair of the conveying roller 14 and the conveying roller 15 may convey the medium fed from the medium feeding roller 11 toward the image forming section 103 provided downstream.

[Image Forming Section 103]

The image forming section 103 may form a toner image which is a non-limiting example of a developer image. The image forming section 103 may include, for example but not limited to, four image forming units, i.e., image forming units 2K, 2Y, 2M, and 2C. The image forming units 2K, 2Y, 2M, and 2C may respectively include, for example but not limited to, light-emitting diode (LED) heads 3K, 3Y, 3M, and 3C, photosensitive drums 4K, 4Y, 4M, and 4C, charging rollers 5K, 5Y, 5M, and 5C, developing rollers 6K, 6Y, 6M, and 6C, toner tanks 7K, 7Y, 7M, and 7C, developing blades 8K, 8Y, 8M, and 8C, toner-feeding sponge rollers 9K, 9Y, 9M, and 9C, and photosensitive drum blades 26K, 26Y, 26M, and 26C.

The LED heads 3K, 3Y, 3M, and 3C may be opposed to the photosensitive drums 4K, 4Y, 4M, and 4C, respectively. Each of the LED heads 3K, 3Y, 3M, and 3C may perform exposure on a surface of corresponding one of the photosensitive drums 4K, 4Y, 4M, and 4C, thereby forming an electrostatic latent image on the surface of the corresponding one of the photosensitive drums 4K, 4Y, 4M, and 4C.

Each of the photosensitive drums 4K, 4Y, 4M, and 4C may be a columnar member that carries the electrostatic latent image on its surface, i.e., its surficial portion. Each of the photosensitive drums 4K, 4Y, 4M, and 4C may include a photoreceptor such as an organic photoreceptor.

Each of the charging rollers 5K, 5Y, 5M, and 5C may electrically charge the surface, i.e., the surficial portion, of corresponding one of the photosensitive drums 4K, 4Y, 4M, and 4C. Each of the charging rollers 5K, 5Y, 5M, and 5C may be in contact with a surface, i.e., a peripheral surface, of the corresponding one of the photosensitive drums 4K, 4Y, 4M, and 4C.

Each of the developing rollers 6K, 6Y, 6M, and 6C may carry on its surface a toner directed to development of the electrostatic latent image. Each of the developing rollers 6K, 6Y, 6M, and 6C may be in contact with the surface, i.e., the peripheral surface of corresponding one of the photosensitive drums 4K, 4Y, 4M, and 4C.

Each of the toner tanks 7K, 7Y, 7M, and 7C may be a container that contains a toner, and may have a toner discharging slot below the container.

Each of the developing blades 8K, 8Y, 8M, and 8C may form a layer of a toner on a surface of corresponding one of the developing rollers 6K, 6Y, 6M, and 6C that are rotating. The layer of the toner may also be referred to as a toner layer. Each of the developing blades 8K, 8Y, 8M, and 8C may control or adjust a thickness of the toner layer. Each of the developing blades 8K, 8Y, 8M, and 8C may include a plate-shaped elastic member, and a tip of the plate-shaped elastic member may be disposed in the vicinity of the surface of the corresponding one of the developing rollers 6K, 6Y, 6M, and 6C. The plate-shaped elastic member may include, for example but not limited to, a material such as stainless steel. Non-limiting examples of the plate-shaped elastic member may include a leaf spring.

Each of the toner-feeding sponge rollers 9K, 9Y, 9M, and 9C may feed the toner to corresponding one of the developing rollers 6K, 6Y, 6M, and 6C. Each of the toner-feeding sponge rollers 9K, 9Y, 9M, and 9C may be in contact with a surface, i.e., a peripheral surface, of the corresponding one of the developing rollers 6K, 6Y, 6M, and 6C.

Each of the photosensitive drum blades 26K, 26Y, 26M, and 26C may scrape off and collect the toner remaining on the surface, i.e., the surficial portion, of corresponding one of the photosensitive drums 4K, 4Y, 4M, and 4C, thereby cleaning the surface of the corresponding one of the photosensitive drums 4K, 4Y, 4M, and 4C. Each of the photosensitive drum blades 26K, 26Y, 26M, and 26C may be in contact with the surface of the corresponding one of the photosensitive drums 4K, 4Y, 4M, and 4C from a counter direction. In other words, each of the photosensitive drum blades 26K, 26Y, 26M, and 26C may protrude in an opposite direction to a rotation direction of the corresponding one of the photosensitive drums 4K, 4Y, 4M, and 4C. Each of the photosensitive drum blades 26K, 26Y, 26M, and 26C may include, for example but not limited to, an elastic member of a material such as polyurethane rubber.

[Transfer Section 104]

The transfer section 104 may transfer, onto the medium, the toner image formed by the image forming section 103. The transfer section 104 may include, for example but not limited to, a conveyance belt 18, a driving roller 17, a driven roller 16, transferring rollers 10K, 10Y, 10M, and 10C, a belt blade 27, and a waste toner box 28. The driving roller 17 may drive the conveyance belt 18. The driven roller 16 may be driven in accordance with the driving roller 17. The transferring rollers 10K, 10Y, 10M, and 10C may be opposed to the photosensitive drums 4K, 4Y, 4M, and 4C, respectively, with the conveyance belt 18 in between.

The conveyance belt 18 may be an endless elastic belt including, for example but not limited to, a resin material such as polyimide resin. The conveyance belt 18 may lie on the driving roller 17, the driven roller 16, and the transferring rollers 10K, 10Y, 10M, and 10C while being stretched. The conveyance belt 18 may circularly rotate in a direction indicated by an arrow in FIG. 1A. The driving roller 17 may drive the conveyance belt 18 with the use of driving force supplied from a conveyance belt motor 801 which will be described later. Each of the transferring rollers 10K, 10Y, 10M, and 10C may electrostatically transfer onto the medium the toner image formed by corresponding one of the image forming units 2K, 2Y, 2M, and 2C while conveying the medium in the conveyance direction. Each of the transferring rollers 10K, 10Y, 10M, and 10C may include, for example but not limited to, a foamable electrically-semiconductive elastic rubber material. Each of the driving roller 17, the driven roller 16, and the transferring rollers 10K, 10Y, 10M, and 10C may be an approximately-columnar member that extends in a lateral direction, and may be rotatable. The lateral direction refers to a direction perpendicular to the paper plane of FIG. 1A. The belt blade 27 may scrape off the waste toner remaining on a surface of the conveyance belt 18, thereby cleaning the surface of the conveyance belt 18. The waste toner box 28 may store the waste toner scraped off and collected by the belt blade 27.

[Fixing Device 105]

The fixing device 105 may include a fixing section 41 and a pressure-applying section 42. The fixing section 41 and the pressure-applying section 42 may be so opposed to each other in the Y-axis direction that the fixing section 41 and the pressure-applying section 42 are allowed to sandwich the medium in between. The fixing device 105 may apply heat and pressure to the toner image transferred on the medium conveyed from the transfer section 104, and thereby fix the toner image to the medium. The fixing device 105 may include, for example but not limited to, a heater portion 791, a thermistor 792, a fixing motor 793, and a cam motor 794. The heater portion 791 may include, for example but not limited to, heaters 50B, 50F, and 55L which will be described later. Details of the fixing device 105 will be also described later.

[Discharging Section 106]

The discharging section 106 may include, for example but not limited to, a discharge sensor 21 and discharging rollers 22 and 23 opposed to each other. The discharge sensor 21 may detect a position of the medium traveling along the conveyance path P after being discharged from the fixing device 105. The discharging rollers 22 and 23 may discharge the medium discharged from the fixing device 105 further to the outside.

As illustrated in FIG. 1B, the image forming apparatus 1 may include, for example but not limited to, a print controller 700, an interface (I-F) controller 710, a receiving memory 720, an image data editing memory 730, an operation section 701, and a sensor group 702. The image forming apparatus 1 may further include, for example but not limited to, a charging voltage controller 740, a head driving controller 750, a developing voltage controller 760, a transfer voltage controller 770, an image formation driving controller 780, a fixing controller 790, a conveyance belt driving controller 800, and a medium-feeding and conveyance driving controller 810 that each receive a command from the print controller 700.

The print controller 700 may include, for example but not limited to, a microprocessor, a read-only memory (ROM), a random-access memory (RAM), and an input-output port. The print controller 700 may execute, for example, a predetermined program and thereby control general processing operation of the image forming apparatus 1. For example, the print controller 700 may receive print data, a control command, or any other data from the I-F controller 710, and generally control the charging voltage controller 740, the head driving controller 750, the developing voltage controller 760, the transfer voltage controller 770, the image formation driving controller 780, the fixing controller 790, the conveyance belt driving controller 800, and the medium-feeding and conveyance driving controller 810, thereby causing printing operation to be performed.

The I-F controller 710 may receive, for example, print data, a control command, or any other data from an external device such as a personal computer (PC), or may transmit a signal related to a state of the image forming apparatus 1.

The receiving memory 720 may temporarily hold the print data received from the external device such as the PC via the I-F controller 710.

The image data editing memory 730 may receive the print data stored in the receiving memory 720 and hold image data resulting from editing of the print data.

The operation section 701 may include, for example but not limited to, an LED lamp and an input section. The LED lamp may be directed to displaying information such as the state of the image forming apparatus 1, for example. The input section may be provided for a user to give an instruction to the image forming apparatus 1. Non-limiting examples of the input section may include a button and a touch panel.

The sensor group 702 may include, for example but not limited to, a temperature sensor 29, a printing density sensor 30, and any other sensor in addition to various sensors monitoring an operating state of the image forming apparatus 1 such as the entrance sensor 12, the writing sensor 13, and the discharge sensor 21 that detect the position of the medium. The temperature sensor 29 may detect a temperature inside the image forming apparatus 1.

The charging voltage controller 740 may apply a charging voltage to each of the charging rollers 5 (5K, 5Y, 5M, and 5C) on the basis of an instruction from the print controller 700, and perform control to electrically charge the surface of each of the photosensitive drums 4K, 4Y, 4M, and 4C.

The head driving controller 750 may control exposure operation of the LED heads 3 (3K, 3Y, 3M, and 3C) on the basis of the image data stored in the image data editing memory 730.

The developing voltage controller 760 may apply a developing voltage to each of the developing rollers 6 (6K, 6Y, 6M, and 6C) on the basis of an instruction from the print controller 700, and so perform control as to develop the toner on the electrostatic latent image formed on the surface of corresponding one of the photosensitive drums 4K, 4Y, 4M, and 4C.

The transfer voltage controller 770 may apply a transfer voltage to each of the transferring rollers 10 (10K, 10Y, 10M, and 10C) on the basis of an instruction from the print controller 700, and so perform control as to transfer the toner image onto the medium.

The image formation driving controller 780 may perform driving control of each of driving motors 781 to 784 on the basis of an instruction from the print controller 700. The driving motors 781 to 784 may drive the photosensitive drums 4K, 4Y, 4M, and 4C, the charging rollers 5K, 5Y, 5M, and 5C, and the developing rollers 6K, 6Y, 6M, and 6C to rotate.

The fixing controller 790 may control fixing operation of the fixing device 105 on the basis of an instruction from the print controller 700. For example, the fixing controller 790 may control a voltage applied to the heater portion 791. The fixing controller 790 may perform ON-OFF control of the voltage applied to the heater portion 791 on the basis of a temperature of the fixing device 105. The temperature of the fixing device 105 may be measured by the thermistor 792. The fixing controller 790 may further control operation of the fixing motor 793, operation of the cam motor 794, and any other operation.

The conveyance belt driving controller 800 may control operation of the conveyance belt motor 801 provided in the image forming apparatus 1 on the basis of an instruction from the print controller 700. The conveyance belt motor 801 may drive the conveyance belt 18.

The medium-feeding and conveyance driving controller 810 may control operation of a medium feeding motor 811 and a conveyance motor 812 provided in the image forming apparatus 1 on the basis of an instruction from the print controller 700.

[Configuration of Fixing Device 105]

Figure 2A:
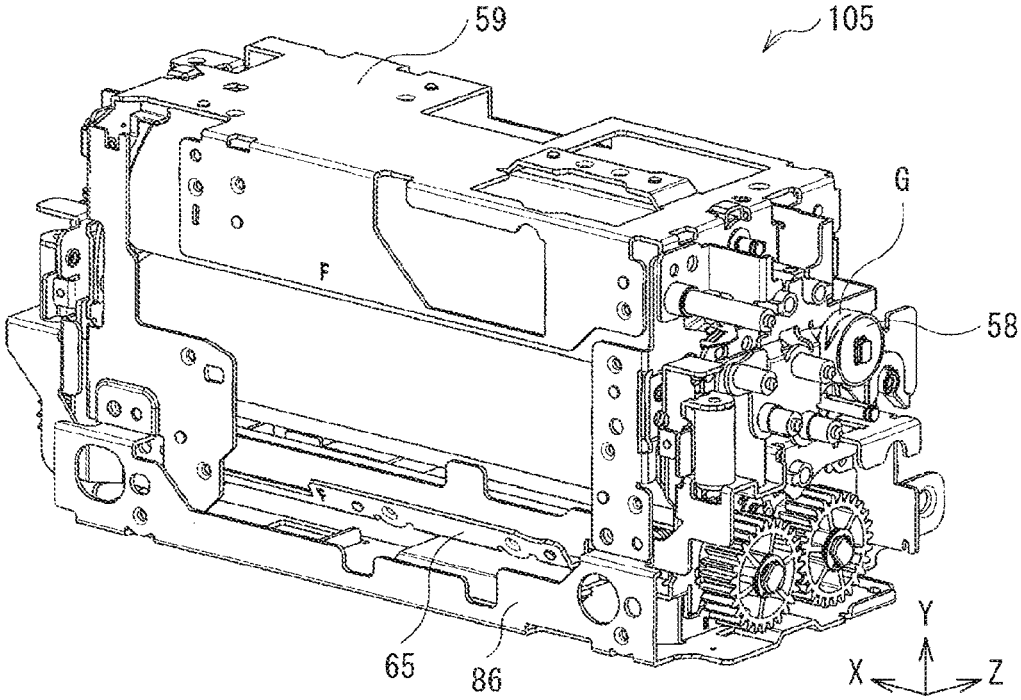
FIG. 2A is an enlarged perspective view of an example of an appearance of a fixing device illustrated in FIG. 1A.
Figure 2B:
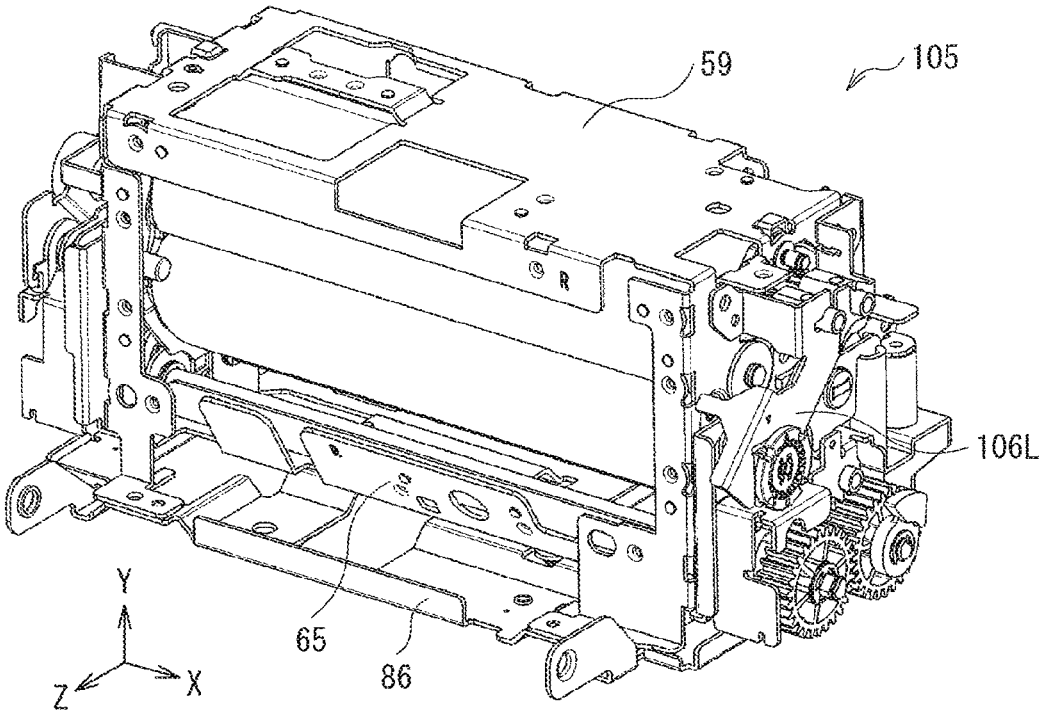
FIG. 2B is another enlarged perspective view of the example of the appearance of the fixing device illustrated in FIG. 1A.
Figure 3:
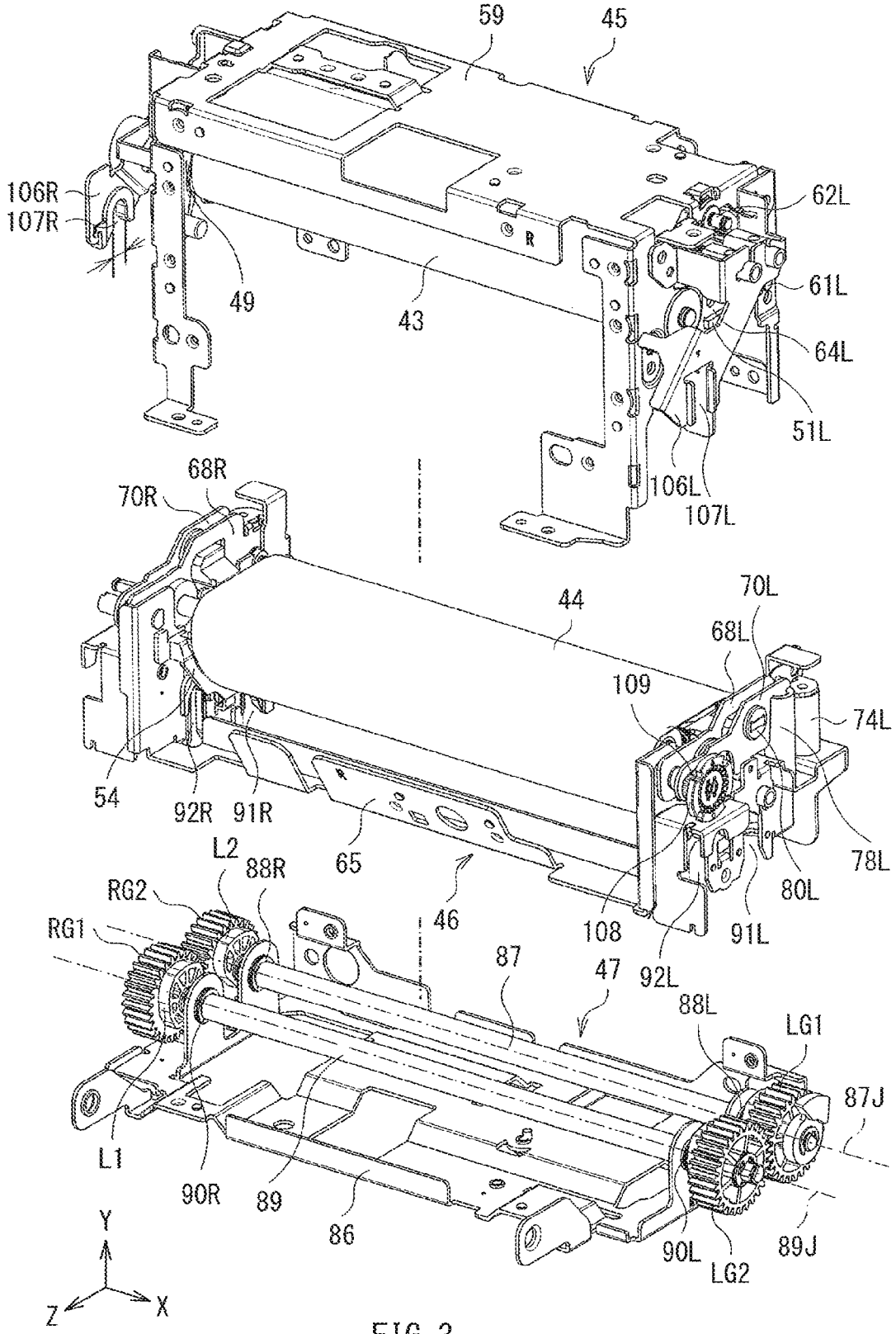
FIG. 3 is an exploded perspective view of an example of a fixing device illustrated in FIG. 2A.
Figure 4:
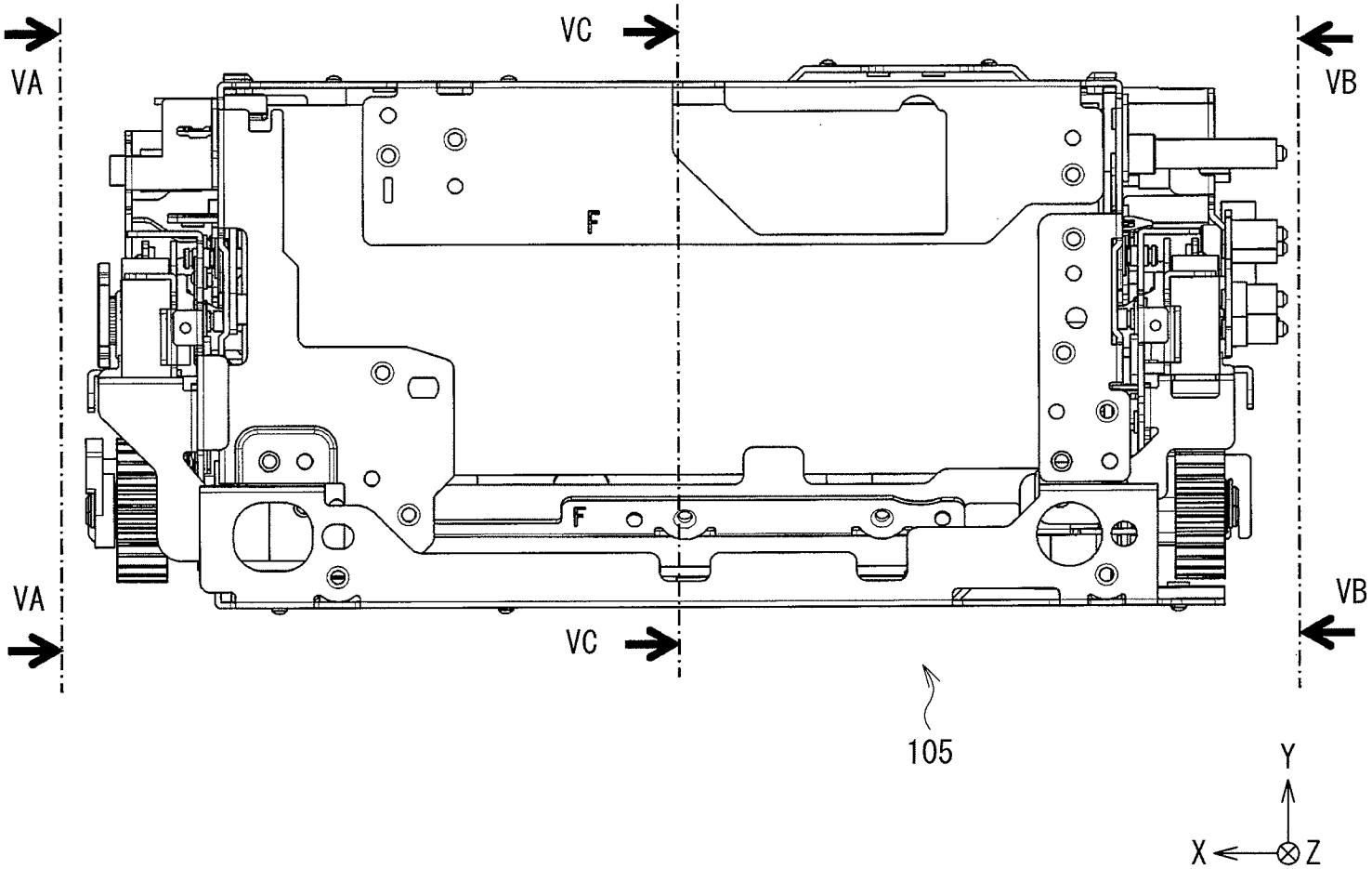
FIG. 4 is a front view of an example of an appearance of the fixing device illustrated in FIG. 1A.
Figure 5A:
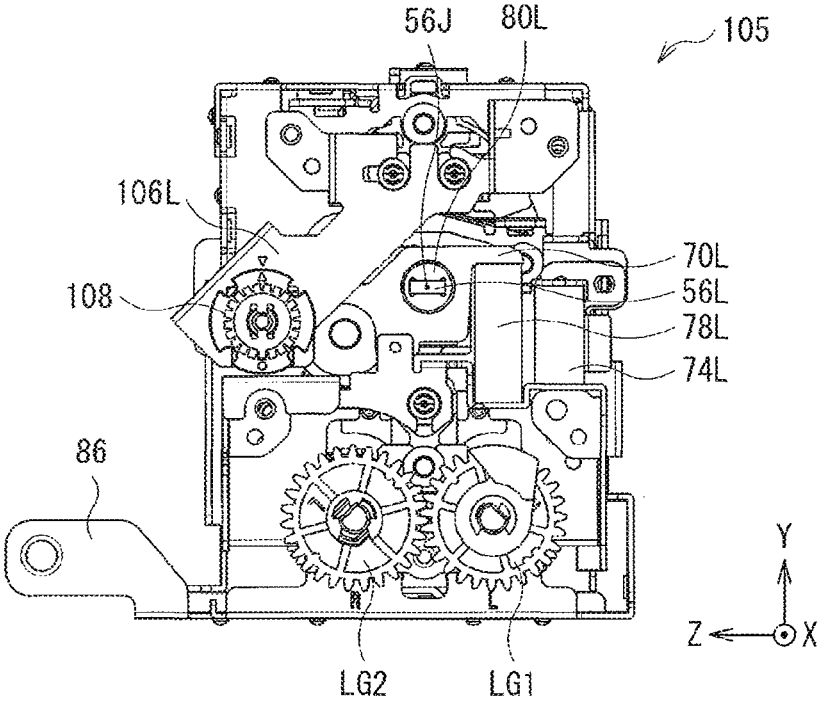
FIG. 5A is a cross-sectional view taken along a line VA-VA of the fixing device illustrated in FIG. 4.
Figure 5B:
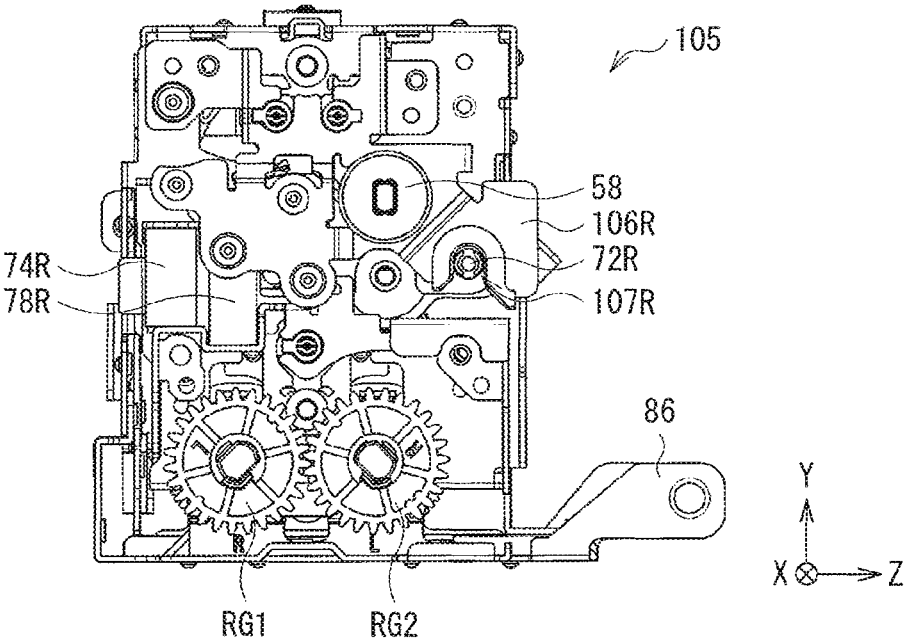
FIG. 5B is a cross-sectional view taken along a line VB-VB of the fixing device illustrated in FIG. 4.
Figure 5C:
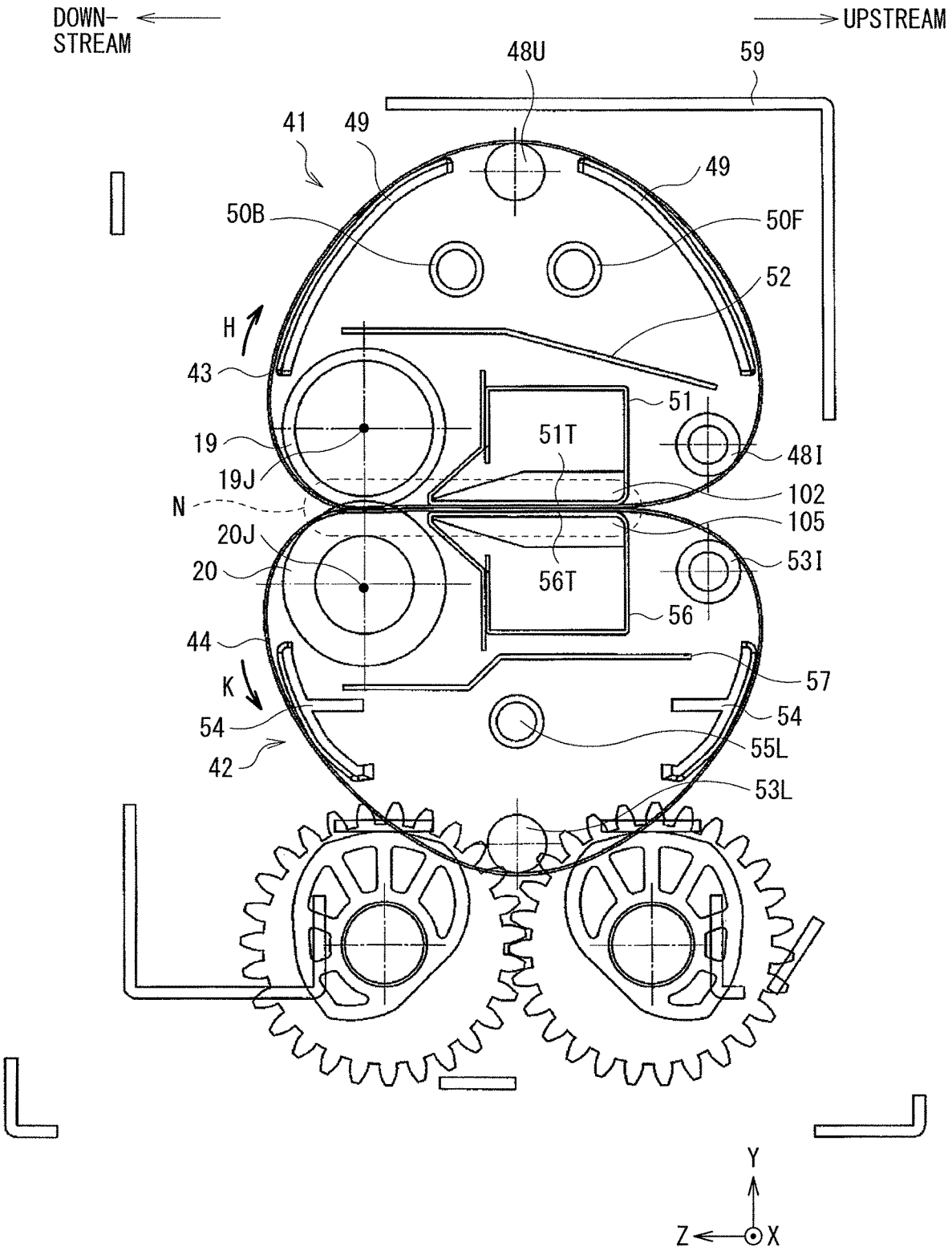
FIG. 5C is a cross-sectional view taken along a line VC-VC of the fixing device illustrated in FIG. 4.
Figure 6A:
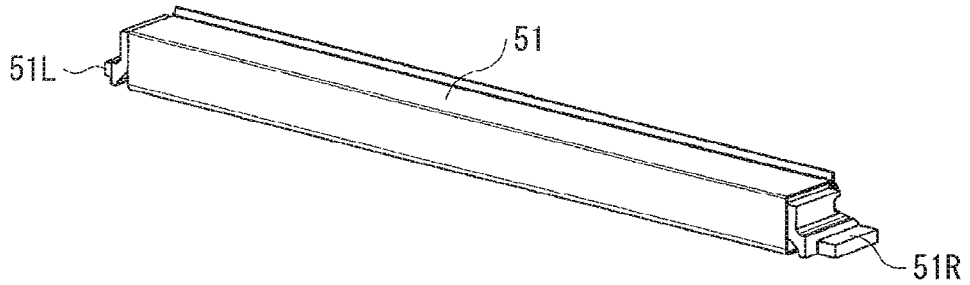
FIG. 6A is a perspective view of an example of an appearance of a member of the fixing device illustrated in FIG. 4.
Figure 6B:
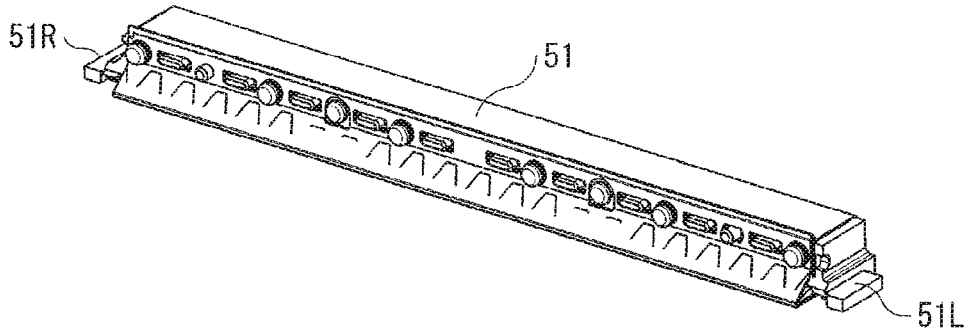
FIG. 6B is a perspective view of an example of the appearance of the member of the fixing device illustrated in FIG. 4.
Figure 7A:
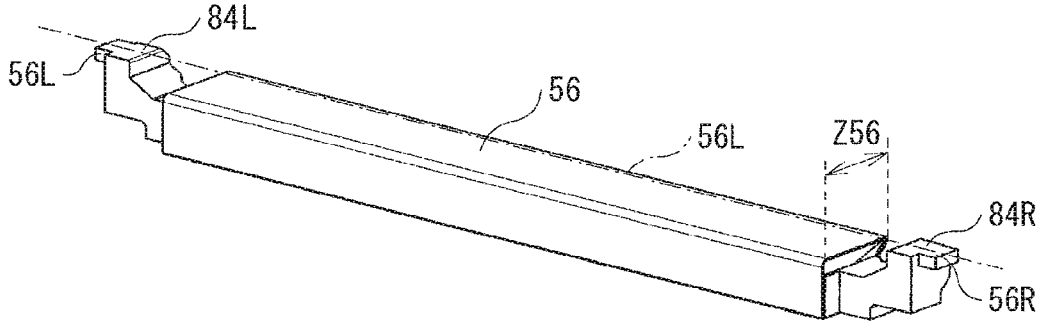
FIG. 7A is a perspective view of an example of an appearance of another member of the fixing device illustrated in FIG. 4.
Figure 7B:
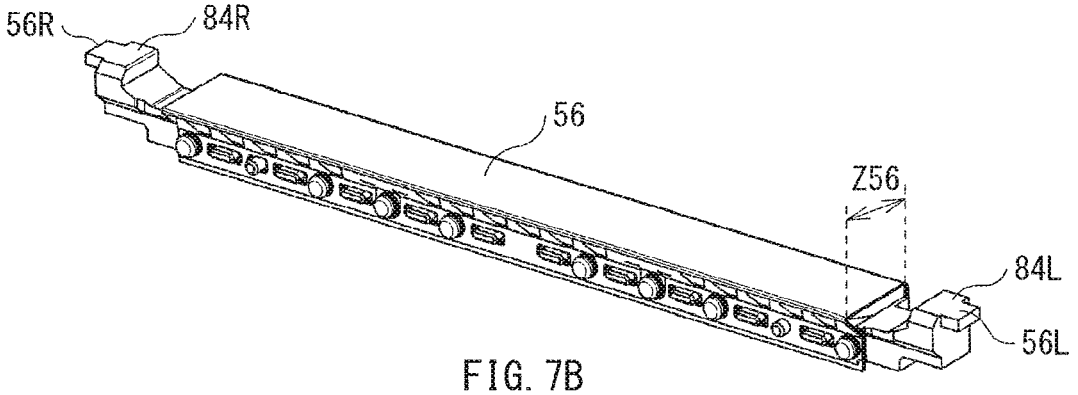
FIG. 7B is a perspective view of an example of the appearance of the other member of the fixing device illustrated in FIG. 4.

A detailed configuration of the fixing device 105 is described below with reference to FIGS. 2A to 9B. FIG. 2A is a perspective view of an appearance of the fixing device 105 viewed from the upstream of the conveyance direction of the medium. FIG. 2B is a perspective view of the appearance of the fixing device 105 viewed from the downstream of the conveyance direction of the medium. FIG. 3 is an exploded perspective view of the fixing device 105 corresponding to FIG. 2B. FIG. 4 is a front view of the fixing device 105 viewed from the upstream of the conveyance direction of the medium. FIGS. 5A to 5C are cross-sectional views respectively taken along a line VA-VA, a line VB-VB, and a line VC-VC viewed from corresponding arrow directions illustrated in FIG. 4. FIGS. 6A and 6B are each a perspective view of an appearance of a fixing pad 51 which will be described later. FIGS. 7A and 7B are each a perspective view of an appearance of a pressure-applying pad 56.

For example, as illustrated in FIG. 3, the fixing device 105 may include, for example but not limited to, an upper section 45, a middle section 46, and a lower section 47. The upper section 45, the middle section 46, and the lower section 47 may be respectively disposed at an upper position, a middle position, and a lower position in the Y-axis direction perpendicular to the Z-axis direction in which the medium is conveyed. The middle section 46 may be interposed between the upper section 45 and the lower section 47 in the Y-axis direction. The middle section 46 may be so held by the upper section 45 and the lower section 47 as to be movable in the Y-axis direction between the upper section 45 and the lower section 47.

[Upper Section 45]

The upper section 45 may be opposed to the middle section 46 in the Y-axis direction. As illustrated in FIG. 5C, the upper section 45 may include, for example but not limited to, an upper chassis 59 and a fixing section 41. The fixing section 41 may be provided in the upper chassis 59. The fixing section 41 may include, for example but not limited to, a fixing belt 43, a fixing roller 19, the fixing pad 51, guiding rollers 48I and 48U, two guides 49, the heaters 50B and 50F, and a fixing reflector 52.

The upper chassis 59 may correspond to a "first supporting member" in one specific but non-limiting embodiment of the technology. The fixing section 41 may correspond to a "first rotation section" in one specific but non-limiting embodiment of the technology.

In one non-limiting example, the fixing belt 43 may include an endless elastic belt including a resin material such as polyimide resin. In another non-limiting example, the fixing belt 43 may include an endless elastic belt including a metal base of metal such as stainless steel and a material such as silicone rubber provided on the metal base. The fixing belt 43 may lie on members including the fixing roller 19, the guiding rollers 48I and 48U, and the guides 49 while being stretched. The fixing belt 43 may circularly rotate in a direction of an arrow H illustrated in FIG. 5C. The fixing belt 43 may be in contact with a pressure-applying belt 44 at a position opposed to the pressure-applying section 42, and thereby provide a nip portion N on an X-Z plane. The pressure-applying belt 44 will be described later. The fixing belt 43 may travel in a +Z direction in the vicinity of the nip portion N. The fixing roller 19, the fixing pad 51, the guiding rollers 48I and 48U, the guides 49, the heaters 50B and 50F, and the fixing reflector 52 may each be disposed in a space surrounded by the fixing belt 43.

The fixing belt 43 may correspond to a "first belt" in one specific but non-limiting embodiment of the technology.

The fixing roller 19 may be in contact with an inner surface of the fixing belt 43 and may be rotatable around a first rotational axis 19J in a clockwise direction, for example. Accordingly, the fixing roller 19 may rotate in the clockwise direction and thereby drive the fixing belt 43 to rotate in the direction of the arrow H. The fixing roller 19 may be opposed to a pressure-applying roller 20 with the fixing belt 43 and the later-described pressure-applying belt 44 in between when the fixing device 105 is operating. The fixing roller 19 may be a columnar or cylindrical rotatable member that extends in the X-axis direction. The fixing roller 19 may include [[a]] rotational axis ends at opposite ends thereof. Each of the opposite rotational axis ends of the fixing roller 19 may be rotatably held by the upper chassis 59. The fixing roller 19 may be rotated by driving force transmitted from the fixing motor 793 illustrated in FIG. 1B via a driving gear 58 attached to an adjacent one of the rotational axis ends.

The fixing roller 19 may correspond to a "first rotating member" in one specific but non-limiting embodiment of the technology.

As illustrated in FIGS. 6A and 6B, the fixing pad 51 may be a prismatic member extending, for example, in the X-axis direction. The fixing pad 51 may so apply pressure to the fixing belt 43 as to bring the fixing belt 43 closer to the pressure-applying section 42 of the middle section 46. In other words, the fixing pad 51 may apply pressure to the fixing belt 43 in a −Y direction. As illustrated in FIG. 5C, the fixing pad 51 may include a flat portion 51T extending in the X-axis direction. The flat portion 51T of a fixing pad 51 may be opposed to a flat portion 56T of the pressure-applying pad 56 with the fixing belt 43 and the pressure-applying belt 44 in between when the fixing device 105 is operating. The flat portion 56T will be described later. As illustrated in FIGS. 6A and 6B, the fixing pad 51 may include protrusions 51L and 51R at respective ends in the X-axis direction. As illustrated in FIG. 3, the protrusion 51L may be fixed to the upper chassis 59 with a holding sheet metal 64L in between. Similarly, the protrusion 51R may be fixed to the upper chassis 59 with a holding sheet metal (not visible in FIG. 3) in between.

The guiding roller 48I may be a cylindrical or columnar rotatable member extending in the X-axis direction. The guiding roller 48I may include rotational axis ends at respective ends, one of which (rotational axis end 61L) is visible in FIG. 3. Each of the rotational axis ends may be rotatably held by the upper chassis 59. Similarly, the guiding roller 48U may be a cylindrical or columnar rotatable member extending in the X-axis direction. The guiding roller 48U may include rotational axis ends (one of which, rotational axis end 62L, is visible in FIG. 3) at respective ends. Each of the rotational axis ends may be rotatably held by the upper chassis 59.

The two guides 49 may guide the fixing belt 43 along a circular path. The two guides 49 may be so fixed to the upper chassis 59 as to sandwich the fixing belt 43 from the X-axis direction.

Each of the heaters 50B and 50F may include a heating member that generates heat to apply the heat to the fixing belt 43. The fixing reflector 52 may reflect the heat generated by the heaters 50B and 50F toward the inner surface of the fixing belt 43 on the opposite side to the fixing roller 19 and the fixing pad 51. Each of the heaters 50B and 50F and the fixing reflector 52 may also be fixed to the upper chassis 59.

The upper chassis 59 may be provided with fitted members 106L and 106R at respective ends in the X-axis direction. The fitted members 106L and 106R may have grooves 107L and 107R, respectively. Each of the grooves 107L and 107R may be open downward, i.e., in the −Y direction. The grooves 107L and 107R may respectively have, for example, widths that are substantially uniform in the Z-axis direction, i.e., the conveyance direction of the medium in the fixing device 105. See width W107L of groove 107 in FIGS. 10A and 10B. An eccentric cam 108 which will be described later may be fitted into the groove 107L. A rotational shaft 72R which will be described later may be fitted into the groove 107R.

The groove 107L may correspond to an "engaging portion" in one specific but non-limiting embodiment of the technology.

[Middle Section 46]

Figure 8A:
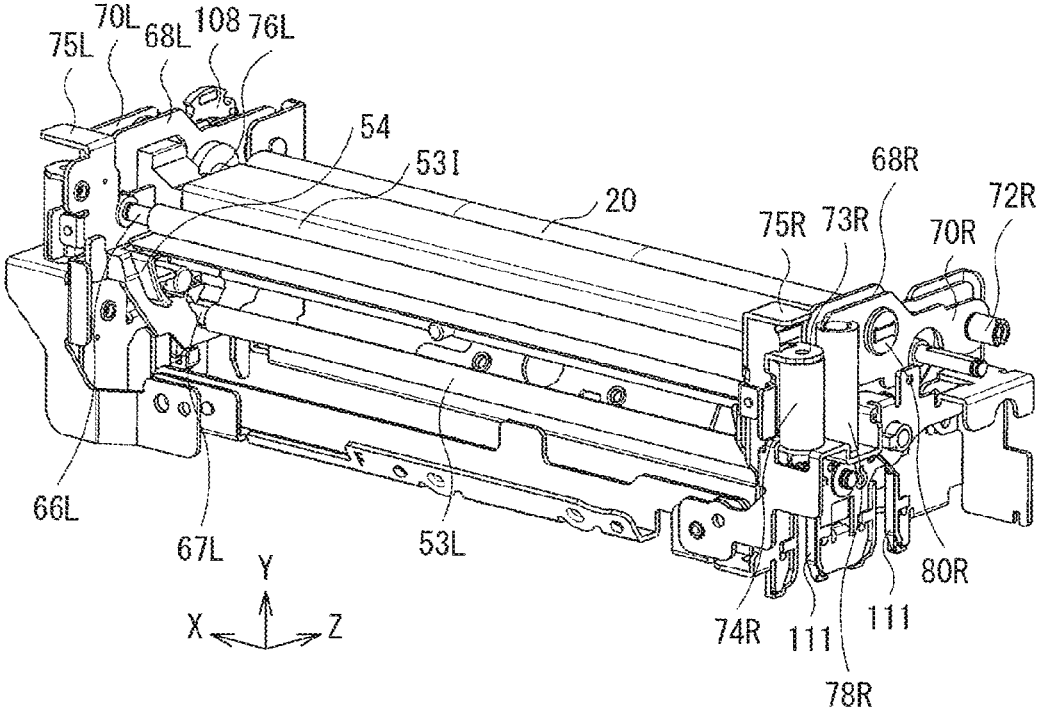
FIG. 8A is a perspective view of an example of an appearance of a middle section of the fixing device illustrated in FIG. 4.
Figure 8B:
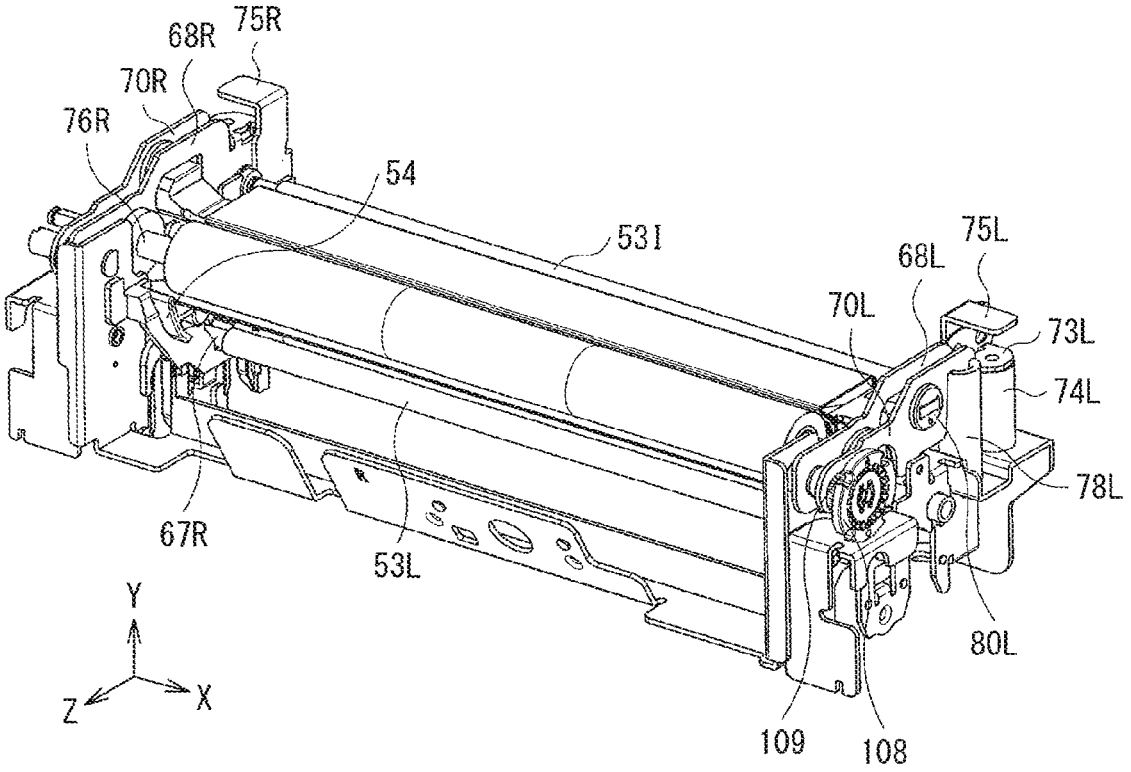
FIG. 8B is another perspective view of an example of the appearance of the middle section of the fixing device illustrated in FIG. 4.
Figure 9A:
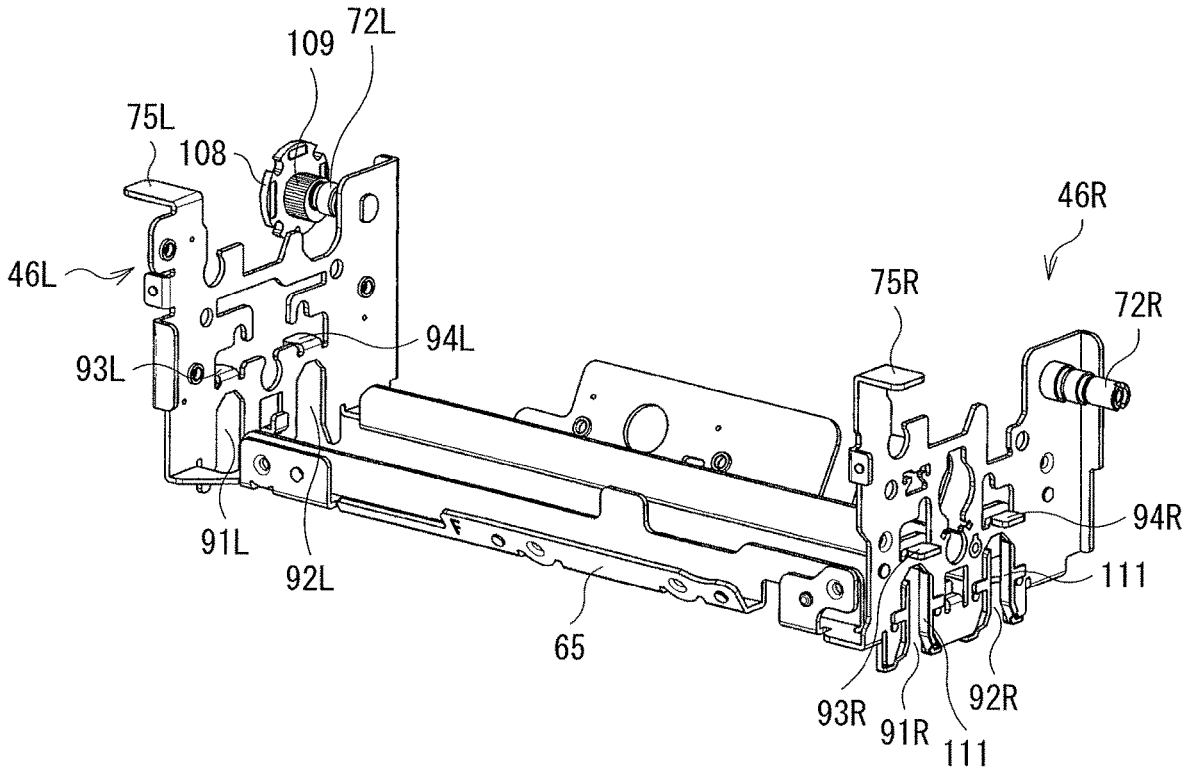
FIG. 9A is a perspective view of an example of a portion of components of the middle section illustrated in FIG. 8A.
Figure 9B:
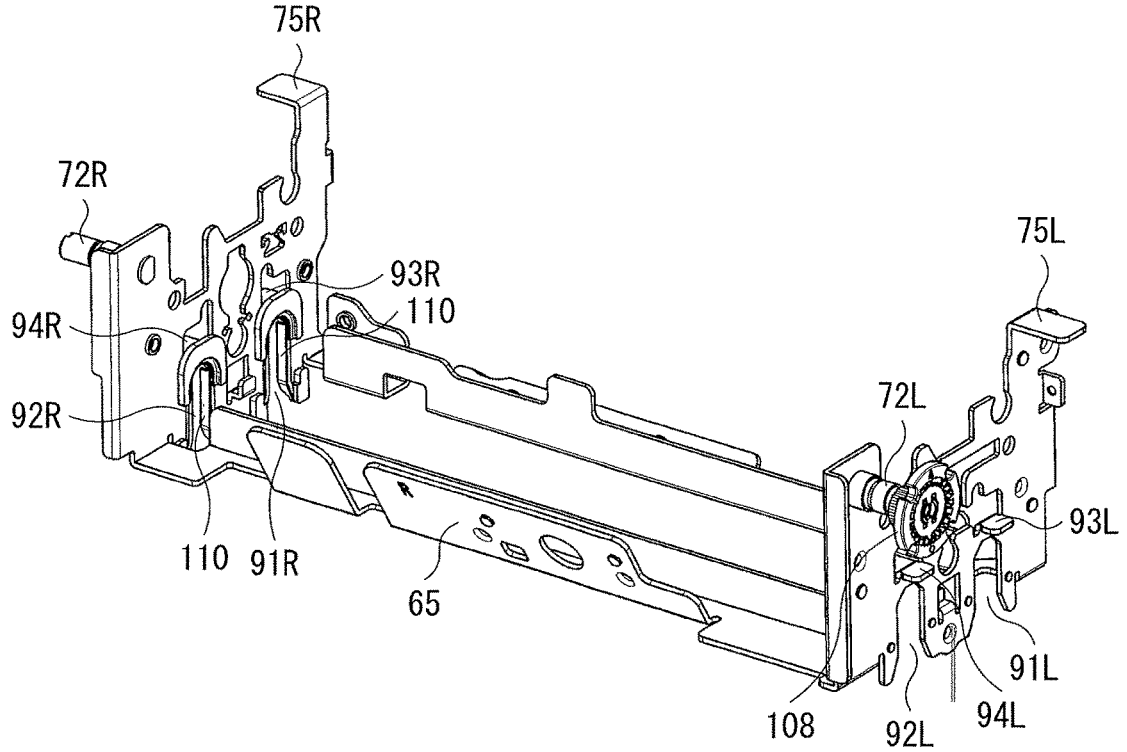
FIG. 9B is a perspective view of an example of a portion of components of the middle section illustrated in FIG. 8B.

The middle section 46 may be opposed to the upper section 45 in the Y-axis direction. As illustrated in FIGS. 3 and 5C, the middle section 46 may include a middle chassis 65 and the pressure-applying section 42 provided in the middle chassis 65. The pressure-applying section 42 may include, for example but not limited to, the pressure-applying belt 44, the pressure-applying roller 20, the pressure-applying pad 56, guiding rollers 53I and 53L, two guides 54, a heater 55L, and a reflector 57. FIGS. 8A and 8B each illustrate an appearance of the middle section 46 omitting the pressure-applying belt 44 for illustration purpose of an inner structure of the middle section 46. FIGS. 9A and 9B each illustrate the appearance of the middle section 46 further omitting the pressure-applying roller 20, the guiding rollers 53I and 53L, and the guides 54.

The middle section 46 may correspond to a "second supporting member" in one specific but non-limiting embodiment of the technology. The pressure-applying section 42 may correspond to a "second rotation section" in one specific but non-limiting embodiment of the technology.

In one non-limiting example, the pressure-applying belt 44 may include an endless elastic belt including a resin material such as polyimide resin. In another non-limiting example, the pressure-applying belt 44 may include an endless elastic belt including a metal base of a material such as stainless steel and a material such as silicone rubber provided on the metal base. The pressure-applying belt 44 may lie on the pressure-applying roller 20, the guiding rollers 53I and 53L, the guides 54, and any other member while being stretched. The pressure-applying belt 44 may circularly rotate in a direction of an arrow K illustrated in FIG. 5C. As illustrated in FIG. 5C, the pressure-applying belt 44 may be in contact with the fixing belt 43 at a position opposed to the fixing section 41, and thereby provide the nip portion N on the X-Z plane. The pressure-applying belt 44 may travel in the +Z direction in the vicinity of the nip portion N, as with the fixing belt 43. The pressure-applying roller 20, the pressure-applying pad 56, the guiding rollers 53I and 53L, the guides 54, the heater 55L, and the reflector 57 may each be disposed in a space surrounded by the pressure-applying belt 44.

It is to be noted that the pressure-applying belt 44 may correspond to a "second belt" in one specific but non-limiting embodiment of the technology.

The pressure-applying roller 20 may be in contact with an inner surface of the pressure-applying belt 44 and may be rotatable around a second rotational axis 20J in a counter-clockwise direction, for example. The pressure-applying roller 20 may be rotated in accordance with the fixing belt 43 together with the pressure-applying belt 44. The pressure-applying roller 20 may be a columnar or cylindrical rotatable member that extends in the X-axis direction. Two ends of the pressure-applying roller 20 may be so supported by a holding portion 76L of a holding arm 68L and a holding portion 76R of a holding arm 68R that the pressure-applying roller 20 is rotatable around the second rotational axis 20J. The holding arms 68L and 68R may be so held by the middle chassis 65 that the holding arms 68L and 68R are rotatable around rotational shafts 72L and 72R provided in the middle chassis 65, respectively. This may allow a position of the pressure-applying roller 20 to be varied with respect to the pressure-applying belt 44. Each of the rotational shafts 72L and 72R may be an approximately-columnar protrusion extending in the X-axis direction. The rotational shaft 72L may be positioned on an extension of the rotational shaft 72R in the X-axis direction.

The pressure-applying roller 20 may correspond to a "second rotating member" in one specific but non-limiting embodiment of the technology.

Figure 23A:
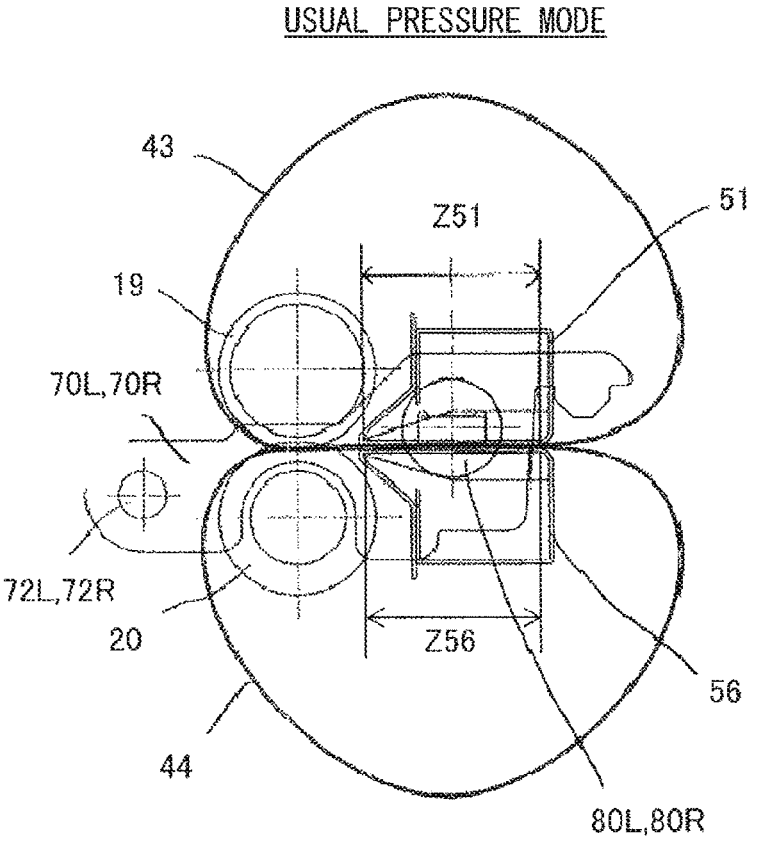
FIG. 23A is a schematic diagram illustrating an example of a positional relationship between a fixing section and a pressure-applying section corresponding to a usual pressure mode in the fixing device illustrated in FIG. 4.
Figure 23B:
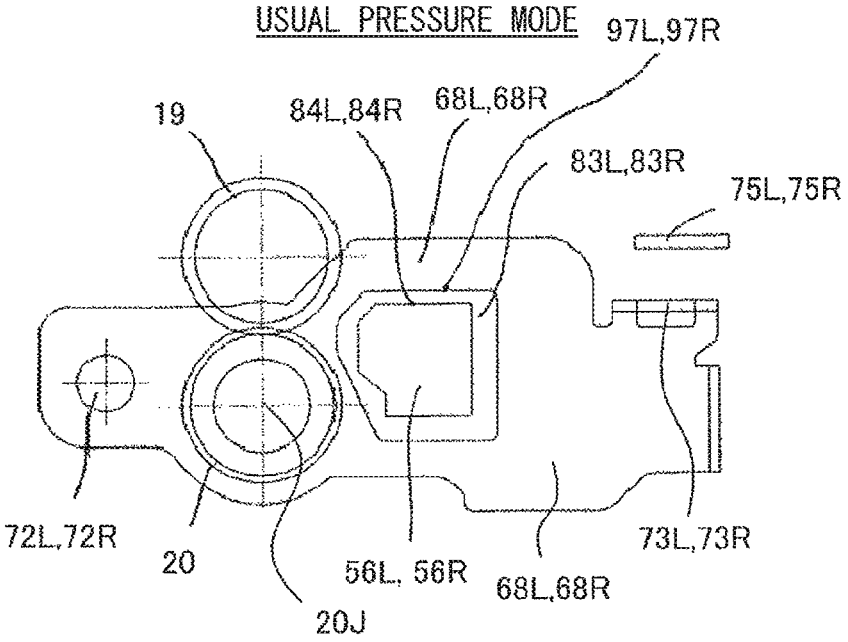
FIG. 23B is another schematic diagram illustrating an example of the positional relationship between the fixing section and the pressure-applying section corresponding to the usual pressure mode in the fixing device illustrated in FIG. 4.

As illustrated in FIGS. 7A and 7B, the pressure-applying pad 56 may be a prismatic member extending in the X-axis direction, for example. The pressure-applying pad 56 may so apply pressure to the pressure-applying belt 44 as to bring the pressure-applying belt 44 closer to the fixing section 41 of the upper section 45. In other words, the pressure-applying pad 56 may apply pressure to the pressure-applying belt 44 in a +Y direction. As illustrated in FIG. 5C, the pressure-applying pad 56 may include the flat portion 56T extending in the X-axis direction. The flat portion 56T of the pressure-applying pad 56 may be opposed to the flat portion 51T of the fixing pad 51 with the fixing belt 43 and the pressure-applying belt 44 in between when the fixing device 105 is operating. The pressure-applying pad 56 may be so held by holding arms 70L and 70R that the pressure-applying pad 56 is rotatable around a rotational axis 56J. The rotational axis 56J may extend in the X-axis direction substantially perpendicular to both the Z-axis direction and the Y-axis direction. For example, as illustrated in FIGS. 7A and 7B, the pressure-applying pad 56 may include protrusions 56L and 56R at respective ends in the X-axis direction. The protrusions 56L and 56R may be so held by the holding arms 70L and 70R with bearings 80L and 80R in between as to be rotatable around the rotational axis 56J. In a specific but non-limiting example, the protrusions 56L and 56R may be fitted into the bearings 80L and 80R, respectively. The bearings 80L and 80R may be inserted into openings in the holding arms 70L and 70R, respectively. The protrusions 56L and 56R may be thus so held by means of the holding arms 70L and 70R as to be rotatable around the rotational axis 56J. The holding arms 70L and 70R may be so held by the middle chassis 65 as to be rotatable around rotational shafts 72L and 72R, respectively. The rotational shafts 72L and 72R may be provided in the middle chassis 65. Accordingly, the holding arm 70L holding the pressure-applying pad 56 and the holding arm 68L holding the pressure-applying roller 20 may be adjacent to each other in the X-axis direction and may pivot around the same rotational shaft 72L in the Y-Z plane. Similarly, the holding arm 70R holding the pressure-applying pad 56 and the holding arm 68R holding the pressure-applying roller 20 may be adjacent to each other in the X-axis direction and may pivot around the same rotational shaft 72R in the Y-Z plane. The protrusions 56L and 56R may include contact surfaces 84L and 84R, respectively (FIG. 23B). The contact surfaces 84L and 84R may come into contact with edges 97L and 97R of through holes 83L and 83R, respectively. The contact surfaces 84L and 84R, the edges 97L and 97R, and the through holes 83L and 83R will be described later.

As illustrated in FIG. 5C, the position of the rotational axis 56J in the Z-axis direction may be the same as a center position of the flat portion 56T of the pressure-applying pad 56 in the Z-axis direction or may be set downstream of the center position in one example embodiment. The position of the rotational axis 56J may correspond to a position of the center of the bearing 80L or 80R. One reason for this is that this allows for a swifter change of a posture of the flat portion 56T of the pressure-applying pad 56 relative to the flat portion 51T of the fixing pad 51 to be closer to a parallel state at the time of a change of a mode of the fixing operation from a separated-away mode to a usual pressure mode or a reduced pressure mode. The fixing operation will be described later. This reduces variation in a nip pressure accompanying the change of the posture, making it easier to obtain a more-stable nip pressure. In addition, setting the position of the rotational axis 56J, corresponding to the position of the center of the bearing 80L or 80R, to be located downstream of the center position may result in a greater nip pressure. Further, a dimension Z56 of the pressure-applying pad 56 in the Z-axis direction may be greater than a dimension Z51 of the fixing pad 51 in the Z-axis direction in one example embodiment. One reason for this is that an increase in length of the nip portion N in the Z-axis direction makes it easier to obtain a more-stable nip pressure.

As illustrated in FIGS. 8A and 8B, the guiding roller 53I may be a cylindrical or columnar rotatable member extending in the X-axis direction. The guiding roller 53I may include rotational axis ends at its respective ends (see e.g. rotational axis end 66L in FIG. 8B). These rotational axis ends may be rotatably held by the middle chassis 65. Similarly, as illustrated in FIGS. 8A and 8B, the guiding roller 53L may be a cylindrical or columnar rotatable member extending in the X-axis direction. The guiding roller 53L may include rotational axis ends 67L and 67R at its respective ends. The rotational axis ends 67L and 67R may be rotatably held by the middle chassis 65.

The two guides 54 may guide the pressure-applying belt 44 along a circular path. The two guides 54 may be so fixed to the middle chassis 65 as to sandwich the pressure-applying belt 44 from the X-axis direction.

The heater 55L may include a heating member that generates heat to apply the heat to the pressure-applying belt 44. The reflector 57 may reflect the heat generated by the heater 55L toward the inner surface of the pressure-applying belt 44 on the opposite side to the pressure-applying roller 20 and the pressure-applying pad 56. The presence of the reflector 57 allows for efficient transmission of the heat generated by the heater 55L to the pressure-applying belt 44. Each of the heater 55L and the reflector 57 may also be fixed to the middle chassis 65.

The middle section 46 may further include first biasing members 74L and 74R and second biasing members 78L and 78R. The first biasing member 74L may include one end in contact with a stopper 73L which is a portion of the holding arm 68L. The first biasing member 74L may include another end in contact with a portion of the middle chassis 65. The first biasing member 74L may bias the stopper 73L in a direction away from the middle chassis 65. The first biasing member 74R may include one end in contact with a stopper 73R which is a portion of the holding arm 68R. The first biasing member 74R may include another end in contact with a portion of the middle chassis 65. The first biasing member 74R may bias the stopper 73R in a direction away from the middle chassis 65. Accordingly, the first biasing members 74L and 74R may so bias the holding arms 68L and 68R, respectively, upward that the pressure-applying roller 20 becomes closer to the upper section 45 in the Y-axis direction. The second biasing member 78L may include one end in contact with a fixed portion of the holding arm 70L. The fixed portion of the holding arm 70L may be positioned at an end of the holding arm 70L on opposite side from the rotational shaft 72L illustrated in FIG. 9B. The second biasing member 78L may include another end in contact with a portion of the middle chassis 65. The second biasing member 78L may bias the end of the holding arm 70L on the opposite side from the rotational shaft 72L in a direction away from the middle chassis 65. The second biasing member 78R may include one end in contact with a fixed portion of the holding arm 70R. The fixed portion of the holding arm 70R may be positioned at an end of the holding arm 70R on opposite side from the rotational shaft 72R illustrated in FIG. 9A. The second biasing member 78R may include another end in contact with a portion of the middle chassis 65. The second biasing member 78R may bias the end of the holding arm 70R on the opposite side from the rotational shaft 72R in a direction away from the middle chassis 65. Accordingly, the second biasing members 78L and 78R may so bias the holding arms 70L and 70R, respectively, upward that the pressure-applying pad 56 becomes closer to the upper section 45 in the Y-axis direction. Each of the first biasing members 74L and 74R and the second biasing members 78L and 78R may include, for example but not limited to, a coiled spring.

The middle section 46 may further include stopping portions 75L and 75R that limit movement of the holding arms 68L and 68R toward the upper section 45, respectively. The stopping portions 75L and 75R may be so provided in the middle chassis 65 that contact of the stopping portions 75L and 75R with the stoppers 73L and 73R stops pivoting of the holding arms 68L and 68R, respectively.

Figure 24A:
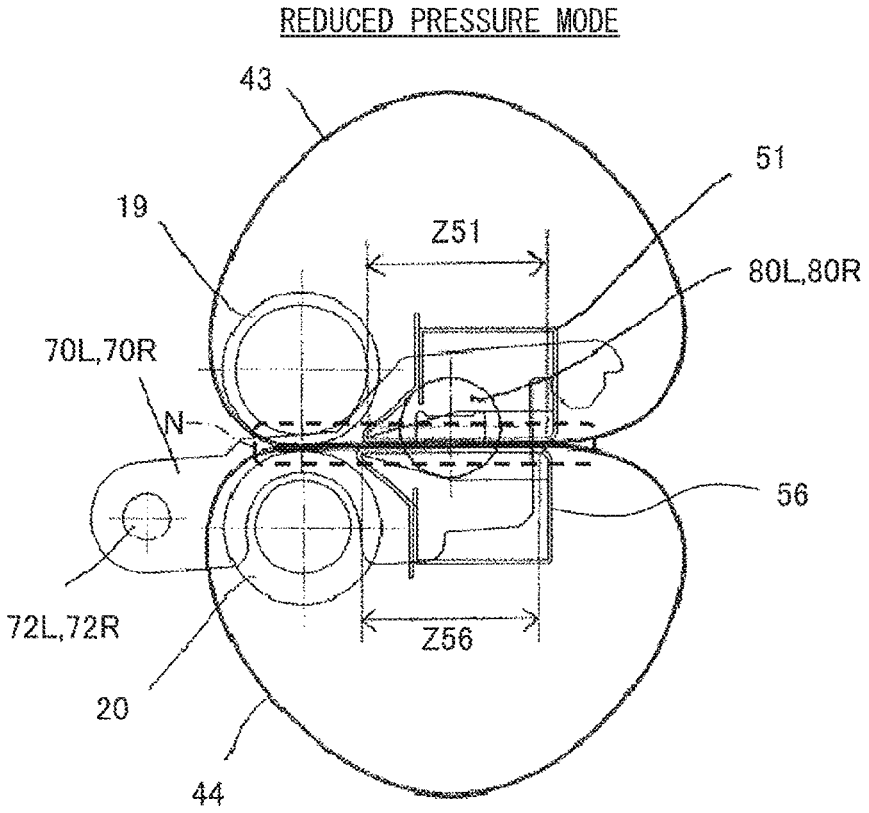
FIG. 24A is a schematic diagram illustrating an example of the positional relationship between the fixing section and the pressure-applying section corresponding to a reduced pressure mode in the fixing device illustrated in FIG. 4.
Figure 24B:
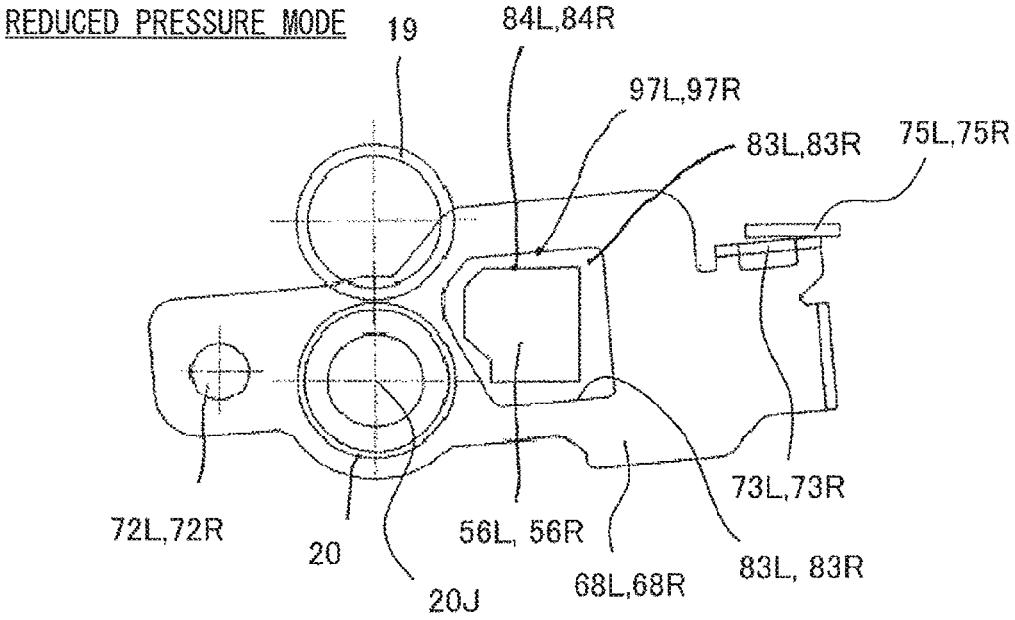
FIG. 24B is another schematic diagram illustrating an example of the positional relationship between the fixing section and the pressure-applying section corresponding to the reduced pressure mode in the fixing device illustrated in FIG. 4.
Figure 25A:
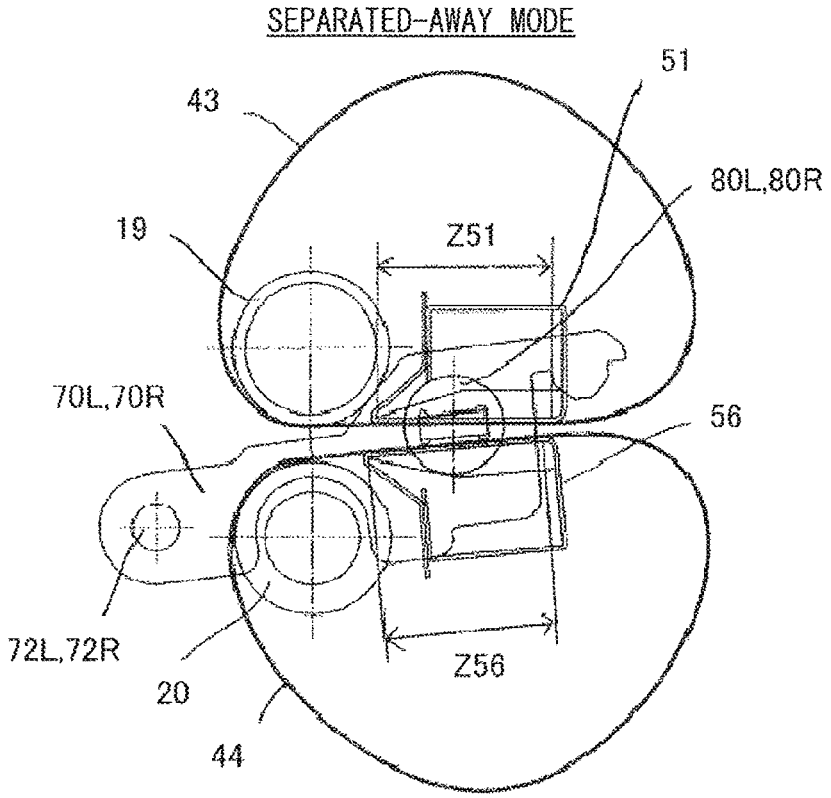
FIG. 25A is a schematic diagram illustrating an example of a positional relationship between the fixing section and the pressure-applying section corresponding to a separated-away mode in the fixing device illustrated in FIG. 4.
Figure 25B:
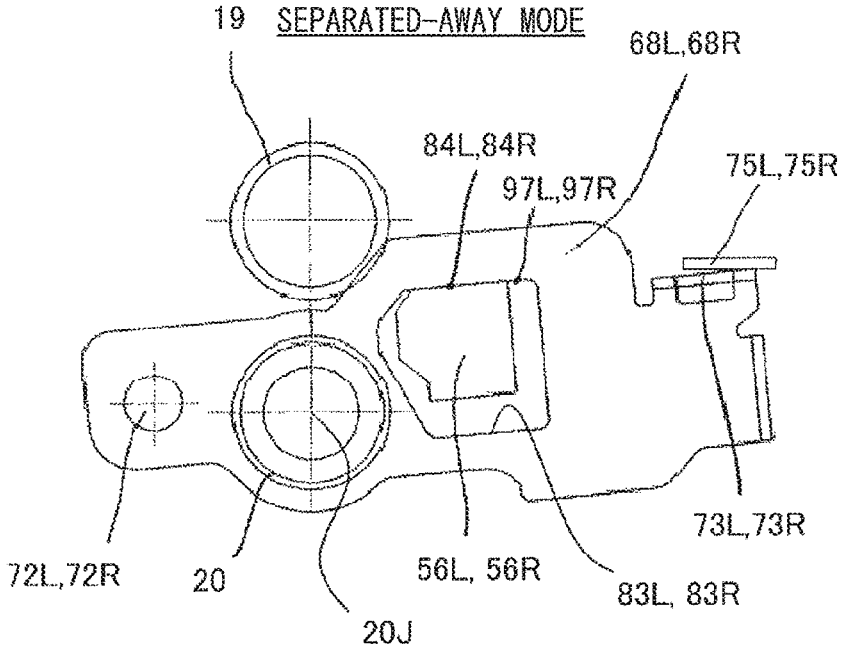
FIG. 25B is another schematic diagram illustrating an example of the positional relationship between the fixing section and the pressure-applying section corresponding to the separated-away mode in the fixing device illustrated in FIG. 4.

As illustrated in FIGS. 23B, 24B, and 25B, the holding arms 68L and 68R may have the through holes 83L and 83R having the edges 97L and 97R, respectively. The protrusions 56L and 56R of the pressure-applying pad 56 may be provided through the through holes 83L and 83R, respectively. Contact of contact surfaces 84L and 84R of the protrusions 56L and 56R with the edges 97L and 97R of the holding arms 68L and 68R may limit movement of the holding arms 70L and 70R toward the upper section 45, respectively.

Figure 10A:
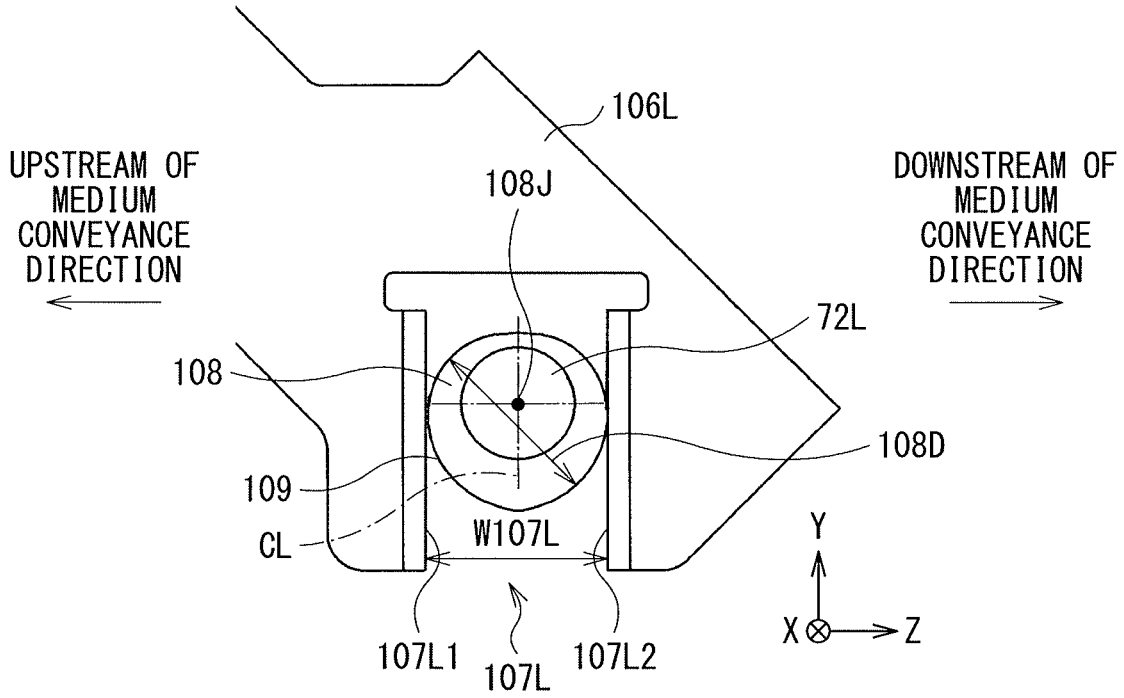
FIG. 10A is a first enlarged side view of a fitting portion of a fitted member and an eccentric cam illustrated in FIG. 3.
Figure 10B:
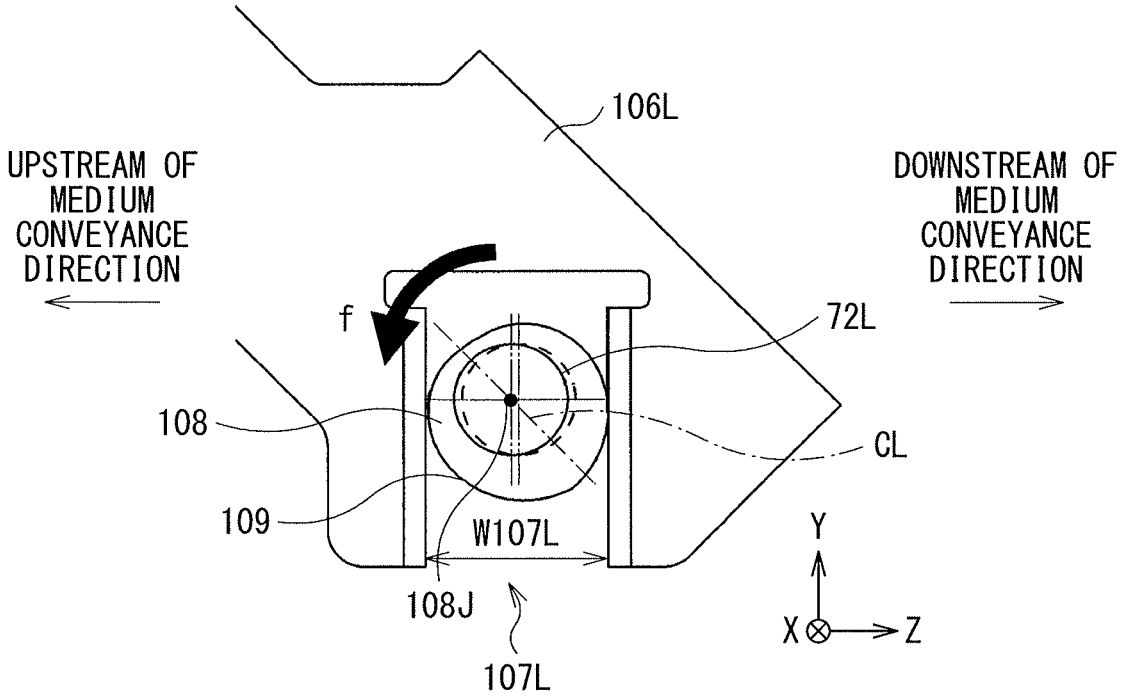
FIG. 10B is a second enlarged side view of the fitting portion of the fitted member and the eccentric cam illustrated in FIG. 3.
Figure 10C:
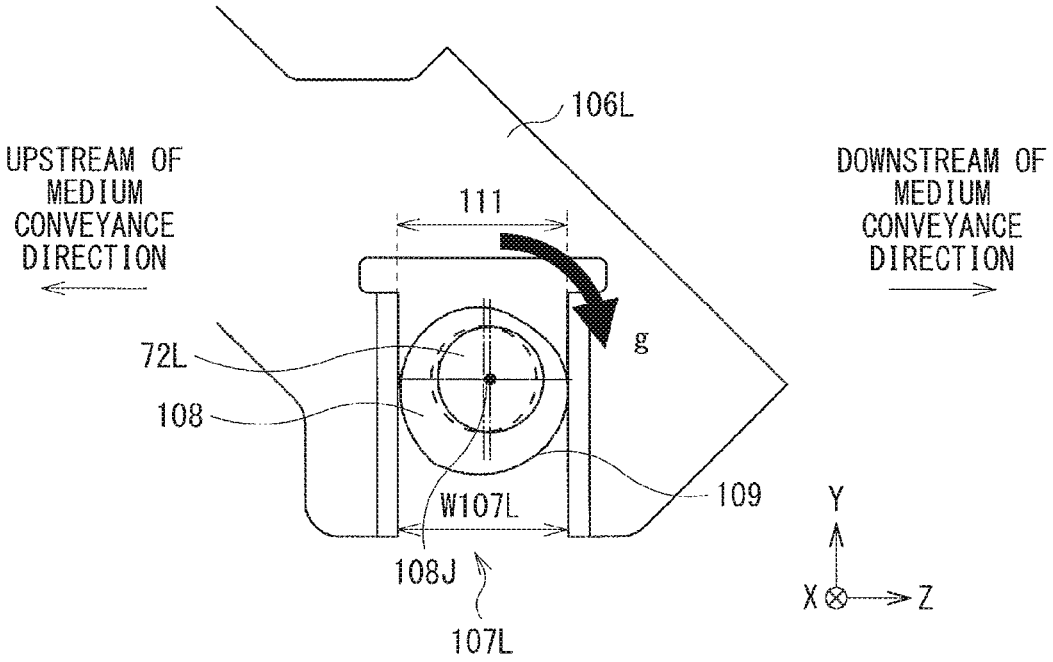
FIG. 10C is a third enlarged side view of the fitting portion of the fitted member and the eccentric cam illustrated in FIG. 3.

The middle section 46 may further include the eccentric cam 108. The eccentric cam 108 may be rotatably attached to the rotational shaft 72L that is positioned at a left end of the middle chassis 65 along the first rotational axis 19J. FIGS. 10A to 10C are each an enlarged side view of the eccentric cam 108 and its vicinity. The eccentric cam 108 may rotate around a cam rotational axis 108J extending in the X-axis direction. The rotation of the eccentric cam 108 around the cam rotational axis 108J may vary relative positions of the upper chassis 59 and the middle chassis 65 to each other, for example, in the Z-axis direction. The eccentric cam 108 may include a cam surface 109 that surrounds the cam rotational axis 108J. A distance from the cam rotational axis 108J to the cam surface 109 in the eccentric cam 108 may not be constant. A distance from the cam rotational axis 108J to any point on the cam surface 109 may gradually vary in accordance with a position of the point. The eccentric cam 108 may have a diameter 108D in a plane perpendicular to the cam rotational axis 108J, i.e., in the Y-Z plane. The diameter 108D may be substantially uniform. As illustrated in FIGS. 10A to 10C, the cam surface 109 may be in contact with both of a pair of opposed surfaces 107L1 and 107L2 of the groove 107L of the fitted member 106L. That is, a width W107L of the groove 107L may be approximately the same as or slightly greater than the diameter 108D of the eccentric cam 108.

FIG. 10A illustrates a posture of the eccentric cam 108 relative to the groove 107L at a reference position. In this situation, a contour of the cam surface 109 in the Y-Z plane may be symmetrical about a line of symmetry CL that extends in the Y-axis direction and passes through the cam rotational axis 108J. Accordingly, a distance from the cam rotational axis 108J to the opposed surface 107L1 and a distance from the cam rotational axis 108J to the opposed surface 107L2 may be substantially the same as each other. In other words, the cam rotational axis 108J may be positioned at a middle point between the opposed surface 107L1 and the opposed surface 107L2 in the Z-axis direction.

FIG. 10B illustrates a state of the eccentric cam 108 having a posture rotated by about 45° to the left of the paper plane, i.e., in a direction indicated by an arrow "f", from the posture at the reference position illustrated in FIG. 10A. In this case, the distance from the cam rotational axis 108J to the opposed surface 107L1 may be smaller than the distance from the cam rotational axis 108J to the opposed surface 107L2. In other words, the cam rotational axis 108J may be positioned closer to the opposed surface 107L1 than the middle point between the opposed surface 107L1 and the opposed surface 107L2 in the Z-axis direction. Accordingly, the end of the middle chassis 65 provided with the rotational shaft 72L may be shifted in the upstream direction, i.e., in a −Z direction, with respect to the upper chassis 59 holding the fitted member 106L, compared to the reference position.

FIG. 10C illustrates a state of the eccentric cam 108 having a posture rotated by about 45° in a direction opposite from that of FIG. 10B, i.e., in a rightward direction on the paper plane indicated by an arrow "g", from the posture at the reference position illustrated in FIG. 10A. In this situation, the distance from the cam rotational axis 108J to the opposed surface 107L1 may be greater than the distance from the cam rotational axis 108J to the opposed surface 107L2. In other words, the cam rotational axis 108J may be positioned closer to the opposed surface 107L2 than the middle point between the opposed surface 107L1 and the opposed surface 107L2 in the Z-axis direction. Accordingly, the end of the middle chassis 65 provided with the rotational shaft 72L may be shifted in the downstream direction, i.e., in the +Z direction, with respect to the upper chassis 59 holding the fitted member 106L, compared to the reference position.

Figure 11B:
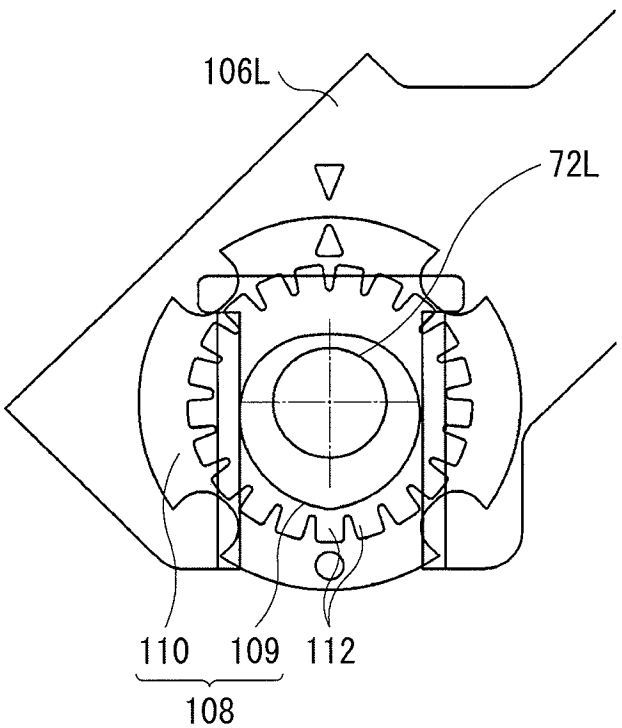
FIG. 11B is a first enlarged schematic projection view of the locking member attached to the fitted member and the eccentric cam illustrated in FIG. 3.
Figure 11A:
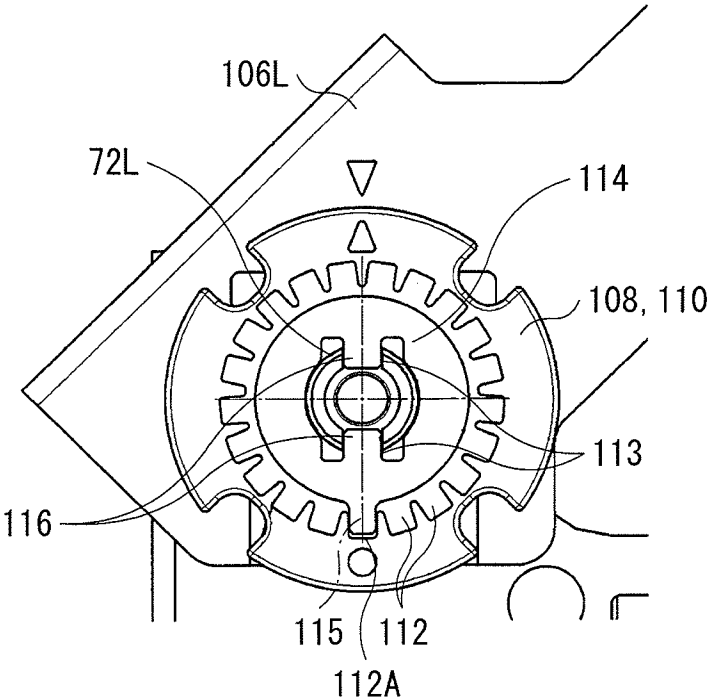
FIG. 11A is a first enlarged side view of a locking member attached to the fitted member and the eccentric cam illustrated in FIG. 3.

For example, as illustrated in FIG. 11A, the middle section 46 may further include a locking member 114 that keeps a rotational angle of the eccentric cam 108 with respect to the groove 107L of the fitted member 106L. FIG. 11A is a first enlarged side view of the locking member 114 attached to the eccentric cam 108 and the rotational shaft 72L and the vicinity of the locking member 114. FIG. 11B is a first schematic projection view corresponding to FIG. 11A.

The eccentric cam 108 may be rotatably attached to the rotational shaft 72L fixed to the middle chassis 65, as described above. As illustrated in FIGS. 11A and 11B, the eccentric cam 108 may further include a flange 110 having a plurality of slots 112 arranged in the rotation direction of the eccentric cam 108. The rotational shaft 72L may have a slit 113 at its outer edge. The locking member 114 may be an approximately-disc-shaped member including a projection 115 and a projection 116. The projection 115 may be engaged with any of the slots 112. The projection 116 may be engaged with the slit 113. The projection 115 may be provided at an outer edge of a lower portion of the locking member 114 in a vertical direction, for example.

The slot 112 may correspond to a "first recess" in one specific but non-limiting embodiment of the technology. The rotational shaft 72L may correspond to a "shaft" in one specific but non-limiting embodiment of the technology. The slit 113 may correspond to a "second recess" in one specific but non-limiting embodiment of the technology. The locking member 114 may correspond to a "rotation controlling member" in one specific but non-limiting embodiment of the technology. The projection 115 may correspond to a "third projection" in one specific but non-limiting embodiment of the technology. The projection 116 may correspond to a "fourth projection" in one specific but non-limiting embodiment of the technology.

FIGS. 11A and 11B correspond to the case illustrated in FIG. 10A where the eccentric cam 108 has the posture at the reference position. As illustrated in FIG. 11A, the projection 115 of the locking member 114 may be engaged with a slot 112A which is one of the slots 112 in this case. Engagement of the projection 115 of the locking member 114 with the slot 112A and engagement of the projection 116 with the slit 113 may keep the posture of the eccentric cam 108 at the reference position.

Figure 12B:
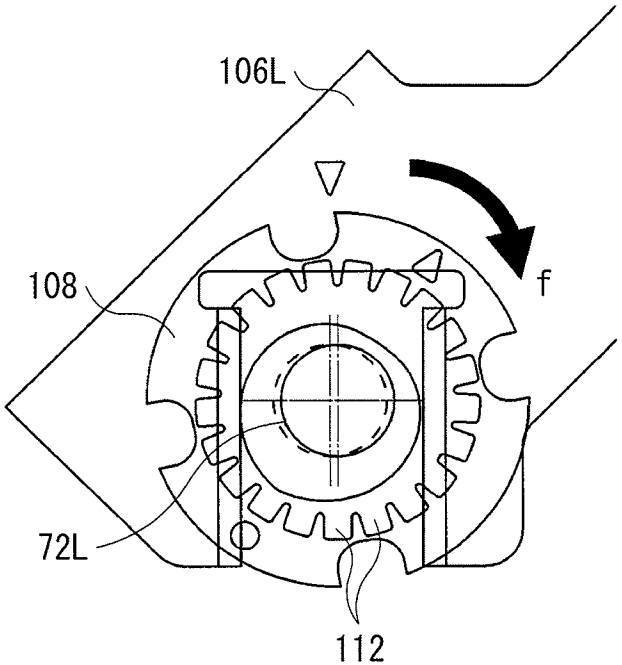
FIG. 12B is a second enlarged schematic projection view of the locking member attached to the fitted member and the eccentric cam illustrated in FIG. 3.
Figure 12A:
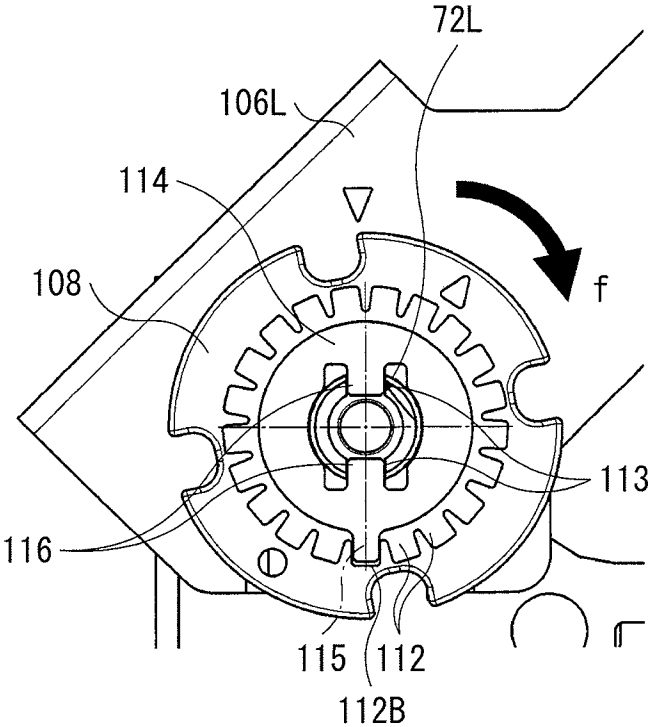
FIG. 12A is a second enlarged side view of the locking member attached to the fitted member and the eccentric cam illustrated in FIG. 3.

FIG. 12A is a second enlarged side view of the locking member 114 attached to the eccentric cam 108 and the rotational shaft 72L and the vicinity of the locking member 114. FIG. 12B is a second schematic projection view corresponding to FIG. 12A. FIGS. 12A and 12B correspond to the case illustrated in FIG. 10B where the eccentric cam 108 has a posture rotated by about 45° in the direction indicated by the arrow "f" from the posture at the reference position illustrated in FIG. 10A. As illustrated in FIGS. 12A and 12B, the projection 115 of the locking member 114 may be engaged with a slot 112B which is another one of the slots 112 different from the slot 112A in this case. Engagement of the projection 115 of the locking member 114 with the slot 112B and engagement of the projection 116 with the slit 113 may keep the posture of the eccentric cam 108 at a position rotated by about 45° in the direction indicated by the arrow "f" from the posture at the reference position.

Figure 13B:
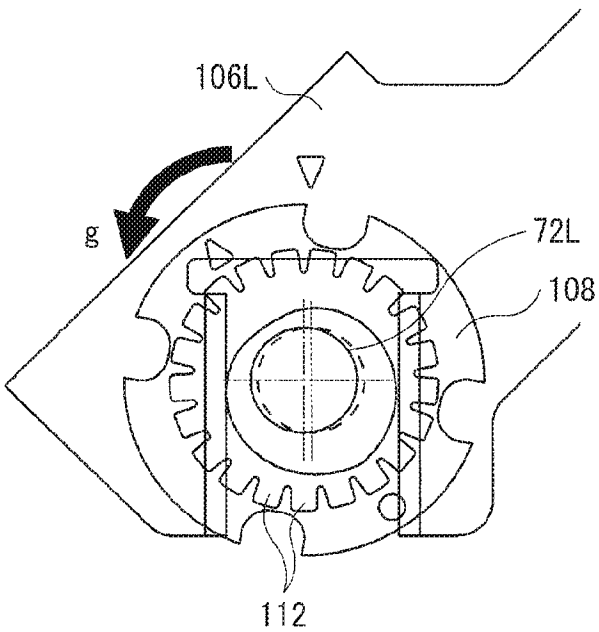
FIG. 13B is a third enlarged schematic projection view of the locking member attached to the fitted member and the eccentric cam illustrated in FIG. 3.
Figure 13A:
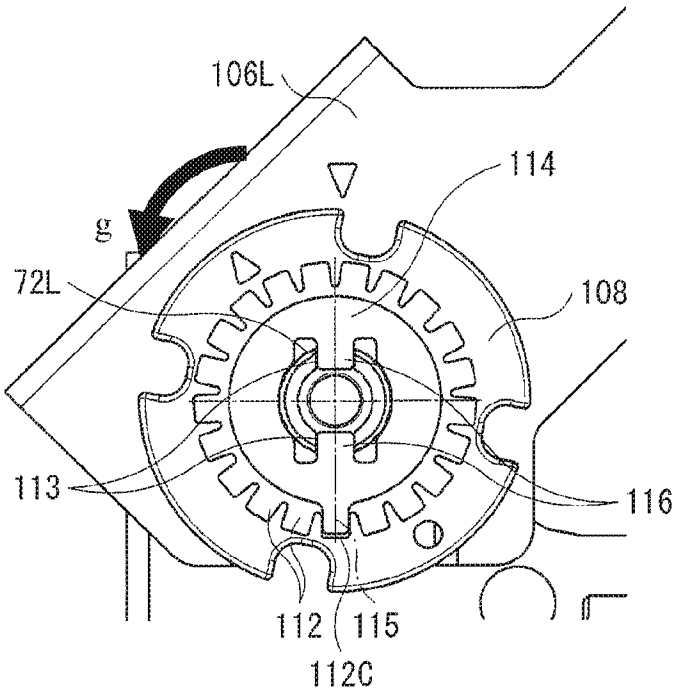
FIG. 13A is a third enlarged side view of the locking member attached to the fitted member and the eccentric cam illustrated in FIG. 3.

FIG. 13A is a third enlarged side view of the locking member 114 attached to the eccentric cam 108 and the rotational shaft 72L and the vicinity of the locking member 114. FIG. 13B is a third schematic projection view corresponding to FIG. 13A. FIGS. 13A and 13B correspond to the case illustrated in FIG. 10C where the eccentric cam 108 has a posture at a position rotated by about 45° in the direction indicated by the arrow "g" from the posture at the reference position illustrated in FIG. 10A. As illustrated in FIGS. 13A and 13B, the projection 115 of the locking member 114 may be engaged with a slot 112C which is still another one of the slots 112 different from the slots 112A and 112B in this case. Engagement of the projection 115 of the locking member 114 with the slot 112C and engagement of the projection 116 with the slit 113 may keep the posture of the eccentric cam 108 at a position rotated by about 45° in the direction indicated by the arrow "g" from the posture at the reference position.

[Lower Unit 47]

Figure 14:
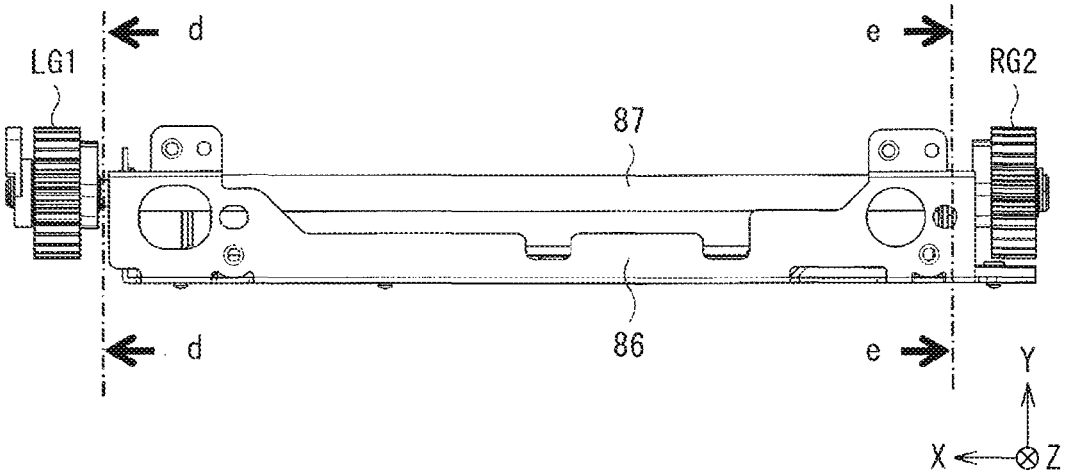
FIG. 14 is a front view of an example of an appearance of a lower section illustrated in FIG. 3.
Figure 15A:
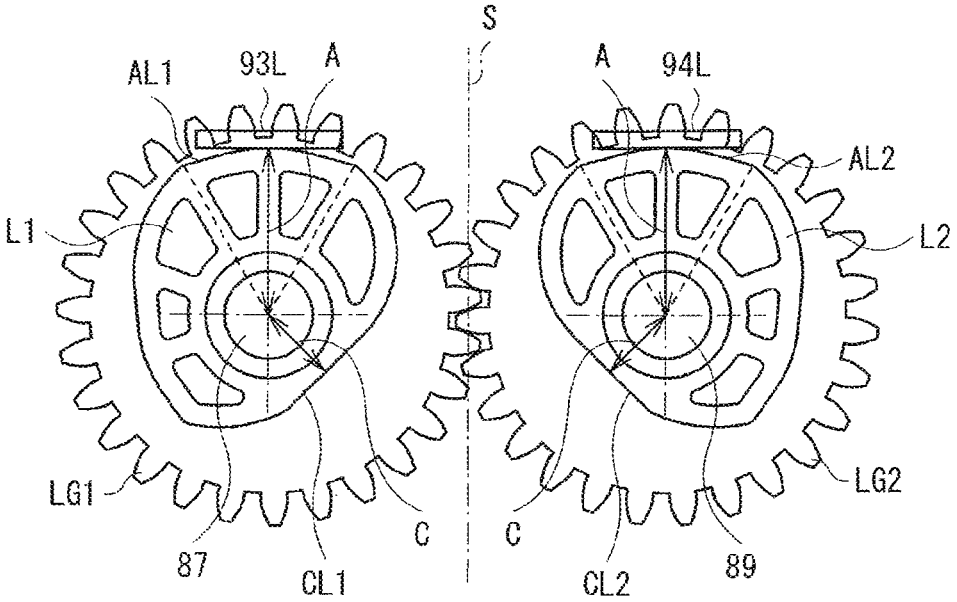
FIG. 15A is a side view of an example of a portion of the fixing device illustrated in FIG. 3 viewed from a direction of an arrow "d" illustrated in FIG. 14, which illustrates a usual pressure state.
Figure 15B:
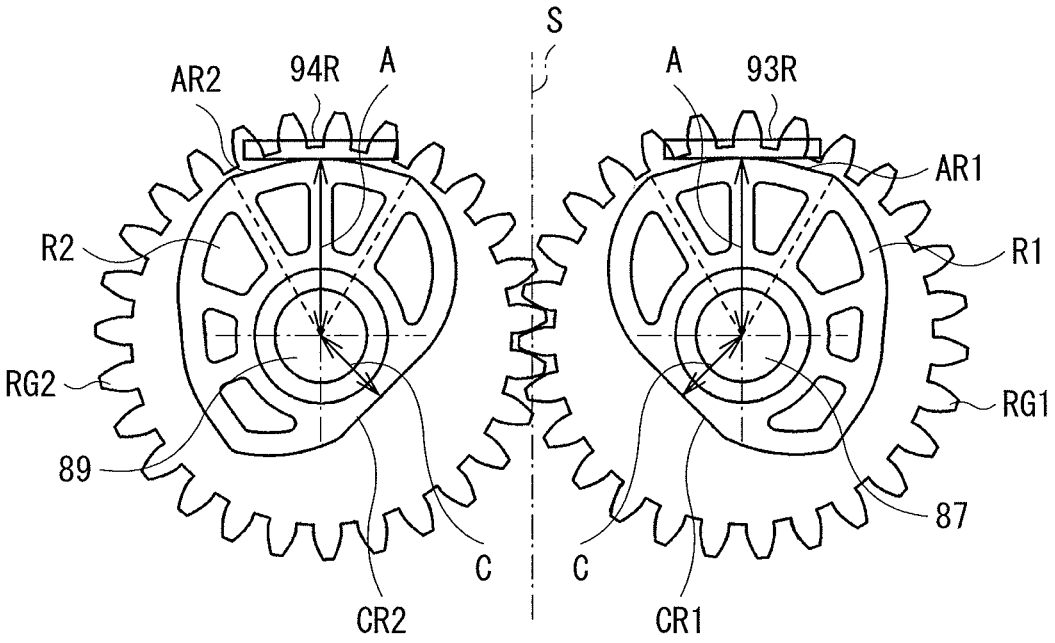
FIG. 15B is a side view of an example of a portion of the fixing device illustrated in FIG. 3 viewed from a direction of an arrow "e" illustrated in FIG. 14, which illustrates the usual pressure state.

A detailed configuration of the lower section 47 is described below referring to FIGS. 14 to 16B in addition to FIGS. 1A to 13B. FIG. 14 is a front view of an appearance of the lower section 47 viewed from the upstream side. FIG. 15A is a side view of a portion of the fixing device 105 in a usual pressure state viewed from a direction of an arrow "d" illustrated in FIG. 14. FIG. 15B is a side view of a portion of the fixing device 105 in the usual pressure state viewed from a direction of an arrow "e" illustrated in FIG.

Figure 16A:
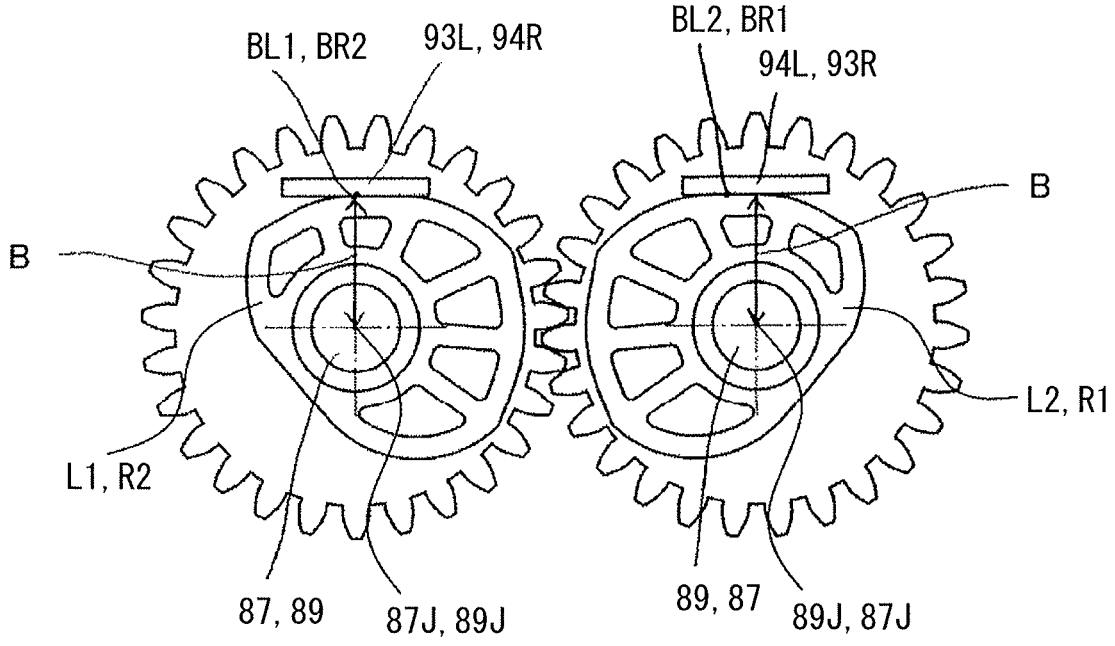
FIG. 16A is a side view of an example of a portion of the fixing device illustrated in FIG. 3 viewed from the direction of the arrow "d" illustrated in FIG. 14, which illustrates a reduced pressure state.
Figure 16B:
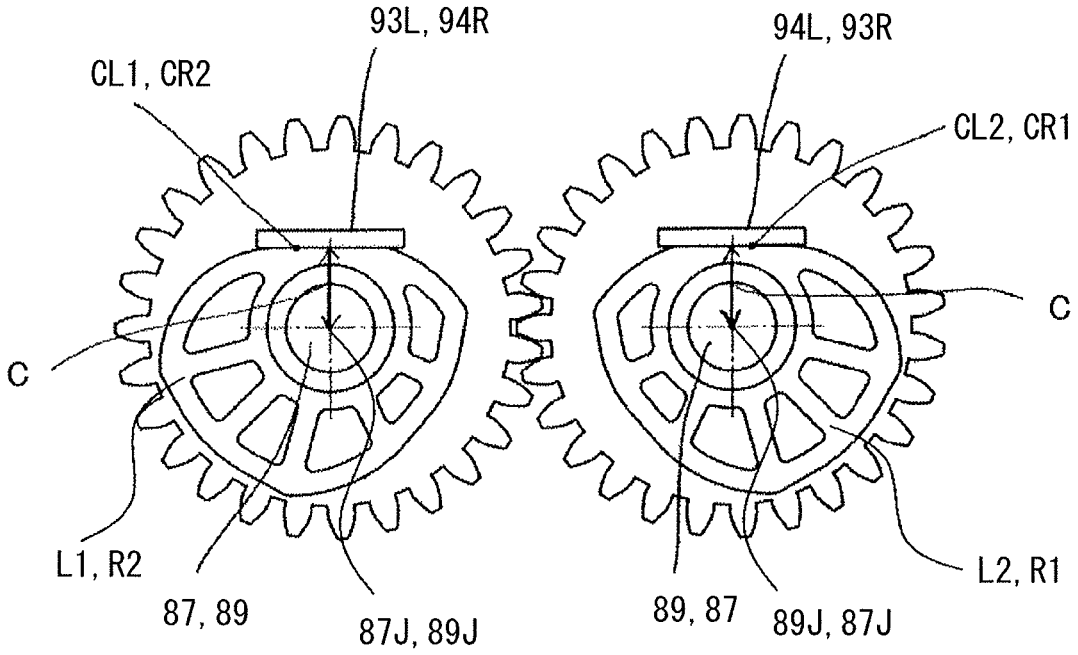
FIG. 16B is a side view of an example of a portion of the fixing device illustrated in FIG. 3 viewed from the direction of the arrow "d" illustrated in FIG. 14, which illustrates a separated-away state.

14. FIG. 16A is a side view of a portion of the fixing device 105 in a reduced pressure state viewed from the direction of the arrow "d". FIG. 16B is a side view of a portion of the fixing device 105 in a separated-away state viewed from the direction of the arrow "d".

The lower section 47 may include, for example but not limited to, a lower chassis 86, a first cam shaft 87, first supporting portions 88L and 88R, first cams L1 and R1, first cam gears LG1 and RG1, a second cam shaft 89, second supporting portions 90L and 90R, second cams L2 and R2, and second cam gears LG2 and RG2. The lower chassis 86 may be fixed to the upper chassis 59, for example, by means of a screw. The first cam shaft 87 and the second cam shaft 89 may be disposed adjacent to each other in the Z-axis direction and may extend in the X-axis direction. The first cam shaft 87 may be rotatably attached to the lower chassis 86 with the first supporting portions 88L and 88R in between. The second cam shaft 89 may be rotatably attached to the lower chassis 86 with the second supporting portions 90L and 90R in between.

The first cam gear LG1 may be provided at one end of the first cam shaft 87, and the first cam gear RG1 may be provided at the other end of the first cam shaft 87. The first cams L1 and R1 may each be fixed to the first cam shaft 87 between the first cam gear LG1 and the first cam gear RG1. For example, the first cam L1 may be in contact with the first cam gear LG1, and the first cam R1 may be in contact with the first cam gear RG1. The first cam shaft 87, the first cams L1 and R1, and the first cam gears LG1 and RG1 may rotate together around an axis 87J extending in the X-axis direction.

The second cam gear LG2 may be provided at one end of the second cam shaft 89, and the second cam gear RG2 may be provided at the other end of the second cam shaft 89. The second cams L2 and R2 may each be fixed to the second cam shaft 89 between the second cam gear LG2 and the second cam gear RG2. For example, the second cam L2 may be in contact with the second cam gear LG2, and the second cam R2 may be in contact with the second cam gear RG2. The second cam shaft 89, the second cams L2 and R2, and the second cam gears LG2 and RG2 may rotate together around an axis 89J extending in the X-axis direction.

For example, as illustrated in FIGS. 15A and 15B, the first cam L1 and the second cam L2 may be in a symmetrical relationship about a virtual center plane S parallel to the X-Y plane. For example, the first cam L1 may include a cam surface AL1, a cam surface BL1, and a cam surface CL1. For example, the second cam L2 may include a cam surface AL2, a cam surface BL2, and a cam surface CL2. The cam surface AL1 and the cam surface AL2 may be positioned to be symmetrical about the virtual center plane S. The cam surface BL1 and the cam surface BL2 may be positioned to be symmetrical about the virtual center plane S. The cam surface CL1 and the cam surface CL2 may be positioned to be symmetrical about the virtual center plane S. This may be similarly applicable to a relationship between the first cam R1 and the second cam R2. That is, the first cam R1 and the second cam R2 may be in a symmetrical relationship about the virtual center plane S parallel to the X-Y plane. For example, the first cam R1 may include a cam surface AR1, a cam surface BR1, and a cam surface CR1. For example, the second cam R2 may include a cam surface AR2, a cam surface BR2, and a cam surface CR2. The cam surface AR1 and the cam surface AR2 may be positioned to be symmetrical about the virtual center plane S. The cam surface BR1 and the cam surface BR2 may be positioned to be symmetrical about the virtual center plane S. The cam surface CR1 and the cam surface CR2 may be positioned to be symmetrical about the virtual center plane S. The first cam L1 and the first cam R1 may match each other in shape and size when viewed from the X-axis direction. Similarly, the second cam L2 and the second cam R2 may match each other in shape and size viewed from the X-axis direction.

Regarding the first cam L1, the cam surface AL1 may be positioned at a distance A from the axis 87J of the first cam shaft 87, being most away from the axis 87J of the first cam shaft 87 among the cam surface AL1, the cam surface BL1, and the cam surface CL1. Regarding the first cam R1, the cam surface AR1 may be positioned at the distance A from the axis 87J of the first cam shaft 87, being most away from the axis 87J of the first cam shaft 87 among the cam surface AR1, the cam surface BR1, and the cam surface CR1. Regarding the second cam L2, the cam surface AL2 may be positioned at the distance A from the axis 89J of the second cam shaft 89, being most away from the axis 89J of the second cam shaft 89 among the cam surface AL2, the cam surface BL2, and the cam surface CL2. Regarding the second cam R2, the cam surface AR2 may be positioned at the distance A from the axis 89J of the second cam shaft 89, being most away from the axis 89J of the second cam shaft 89 among the cam surface AR2, the cam surface BR2, and the cam surface CR2.

The cam surfaces BL1 and BR1 may each be positioned at a distance B from the axis 87J. The cam surfaces CL1 and CR1 may each be positioned at a distance C from the axis 87J. The cam surfaces BL2 and BR2 may each be positioned at the distance B from the axis 89J. The cam surfaces CL2 and CR2 may each be positioned at the distance C from the axis 89J.

The two ends of the middle chassis 65 of the middle section 46 in the X-axis direction may be provided with contact protruding plates 93L, 93R, 94L, and 94R. The contact protruding plate 93L may come into contact with any of the cam surfaces AL1, BL1, and CL1 depending on the rotational position of the first cam L1. The contact protruding plate 93R may come into contact with any of the cam surfaces AR1, BR1, and CR1 depending on the rotational position of the first cam R1. The contact protruding plate 94L may come into contact with any of the cam surfaces AL2, BL2, and CL2 depending on the rotational position of the second cam L2. The contact protruding plate 94R may come into contact with any of the cam surfaces AR2, BR2, and CR2 depending on the rotational position of the second cam R2.

The middle chassis 65 of the middle section 46 may have first slits 91L and 91R, second slits 92L and 92R, and third slits) that each extend in the Y-axis direction. The upper chassis 59 of the upper section 45 may be provided with posts. In the fixing device 105, the first cam shaft 87 may be inserted into the first slits 91L and 91R, the second cam shaft 89 may be inserted into the second slits 92L and 92R, and the posts may be respectively inserted into the third slits. The first cam shaft 87 may be guided in the Y-axis direction by the first slits 91L and 91R. The second cam shaft 89 may be guided in the Y-axis direction by the second slits 92L and 92R. The posts may be respectively guided in the Y-axis direction by the third slits.

In one example embodiment, the first slit 91R and the second slit 92R may be provided with a low-friction member 111 including, for example, resin. In this case, the first slit 91R and the second slit 92R may be respectively engaged with the first cam shaft 87 and the second cam shaft 89 with the low-friction members 111 in between. This allows for smoother sliding of the middle section 46 in the Y-axis direction. In one example embodiment, a clearance between the first slit 91R and the first cam shaft 87 may be sufficiently smaller than a clearance between the first slit 91L and the first cam shaft 87. Similarly, a clearance between the second slit 92R and the second cam shaft 89 may be sufficiently smaller than a clearance between the second slit 92L and the second cam shaft 89. The clearance between the first slit 91L and the first cam shaft 87 and the clearance between the second slit 92L and the second cam shaft 89 may each be about 1 mm, for example. Accordingly, a space may be present for a left end 46L of the middle section 46 in the X-axis direction to move in the Z-axis direction with respect to the upper section 45 and the lower section 47. In contrast, a space may be hardly present for a right end 46R of the middle section 46 in the X-axis direction to move in the Z-axis direction with respect to the upper section 45 and the lower section 47.

As described above, the weight of the middle section 46 may cause substantially constant contact of the contact protruding plates 93L, 93R, 94L, and 94R with the first cams L1 and R1 and the second cams L2 and R2. Accordingly, variation in the positions of the contact protruding plates 93L, 93R, 94L, and 94R in accordance with the rotation operation of the first cams L1 and R1 and the second cams L2 and R2 may cause the middle chassis 65 to move upward or downward, i.e., in the Y-axis direction. For example, the middle chassis 65 may be positioned at the highest when the cam surfaces AL1, AR1, AL2, and AR2 are respectively in contact with the contact protruding plates 93L, 93R, 94L, and 94R. For example, the middle chassis 65 may be positioned at the lowest when the cam surfaces CL1, CR1, CL2, and CR2 are respectively in contact with the contact protruding plates 93L, 93R, 94L, and 94R. For example, the middle chassis 65 may be positioned at a middle height when the cam surfaces BL1, BR1, BL2, and BR2 are respectively in contact with the contact protruding plates 93L, 93R, 94L, and 94R. One reason for this is that the distance A may be greater than both the distances B and C and the distance C may be smaller than both the distances A and B.

Example Workings and Example Effects

[A. Basic Operation]

The image forming apparatus 1 may transfer the toner image onto the medium as follows, for example.

For example, as illustrated in FIG. 1A, first, the medium contained in the medium cassette 24 may be picked up one by one from the top by the medium feeding roller 11. The medium picked up may be fed toward the medium conveying section 102 positioned downstream. The medium fed by the medium feeding roller 11 may be thereafter conveyed toward the image forming section 103 and the transfer section 104 positioned downstream with a skew of the medium being corrected by the medium conveying section 102. A toner image may be transferred onto the medium in the image forming section 103 and the transfer section 104 as follows, for example.

When the print controller 700 of the operating image forming apparatus 1 receives the print image data and a printing command from the external device such as the PC via the I-F controller 710, the print controller 700 may start printing operation of the print image data on the basis of the printing command in association with a controller such as the image formation driving controller 780.

The image formation driving controller 780 may drive the driving motors 781 to 784 and thereby cause the photosensitive drums 4K, 4Y, 4M, and 4C to rotate in a predetermined direction at a constant speed. When the photosensitive drums 4K, 4Y, 4M, and 4C rotate, motive power of the rotation may be transmitted via a driving transmitting section such as a gear string to each of the toner-feeding sponge rollers 9K, 9Y, 9M, and 9C, the developing rollers 6K, 6Y, 6M, and 6C, and the charging rollers 5K, 5Y, 5M, and 5C. As a result, each of the toner-feeding sponge rollers 9K, 9Y, 9M, and 9C, the developing rollers 6K, 6Y, 6M, and 6C, and the charging rollers 5K, 5Y, 5M, and 5C may rotate in a predetermined direction.

On the basis of a command from the print controller 700, the charging voltage controller 740 may apply a predetermined voltage to each of the charging rollers 5K, 5Y, 5M, and 5C and thereby electrically charge the surfaces of the photosensitive drums 4K, 4Y, 4M, and 4C uniformly.

Thereafter, the head driving controller 750 may activate the LED heads 3K, 3Y, 3M, and 3C and thereby apply light corresponding to the print image based on an image signal to the photosensitive drums 4K, 4Y, 4M, and 4C, forming electrostatic latent images on the surfaces of the photosensitive drums 4K, 4Y, 4M, and 4C, respectively. Further, the toners may be fed from the toner tanks 7K, 7Y, 7M, and 7C to the toner-feeding sponge rollers 9K, 9Y, 9M, and 9C, respectively. The toners may be carried by the toner-feeding sponge rollers 9K, 9Y, 9M, and 9C and may move to the vicinity of the developing rollers 6K, 6Y, 6M, and 6C in accordance with the rotation of the toner-feeding sponge rollers 9K, 9Y, 9M, and 9C. On this occasion, the toners may be, for example, negatively charged as a result of potential differences between potentials of the developing rollers 6K, 6Y, 6M, and 6C and potentials of the toner-feeding sponge rollers 9K, 9Y, 9M, and 9C and may be fed to the developing rollers 6K, 6Y, 6M, and 6C, respectively. The toners fed to the developing rollers 6K, 6Y, 6M, and 6C may become toner layers with predetermined thicknesses controlled by the developing blades 8K, 8Y, 8M, and 8C, respectively.

The toner layers on the developing rollers 6K, 6Y, 6M, and 6C may be developed in accordance with the electrostatic latent images formed on the surfaces of the photosensitive drums 4K, 4Y, 4M, and 4C, respectively. Toner images may be thereby formed on the respective photosensitive drums 4K, 4Y, 4M, and 4C. The toner images may be transferred onto the medium by means of electric fields between the photosensitive drums 4K, 4Y, 4M, and 4C and the transferring rollers 10K, 10Y, 10M, and 10C. The transferring rollers 10K, 10Y, 10M, and 10C may be opposed to the photosensitive drums 4K, 4Y, 4M, and 4C, respectively, and may receive a predetermined voltage from the transfer voltage controller 770.

Thereafter, the fixing device 105 may apply heat and pressure to the toner images transferred onto the medium. The toner images may be thereby fixed to the medium. Thereafter, the medium with the fixed toner images may be discharged to the outside by the discharging section 106. A small amount of toner which has not been transferred onto the medium may possibly remain on the photosensitive drums 4K, 4Y, 4M, and 4C in some cases. In this case, the remaining toner may be removed by the photosensitive drum blades 26K, 26Y, 26M, and 26C. This allows for continuous use of the photosensitive drums 4K, 4Y, 4M, and 4C.

[B. Method of Adjusting Fixing Device 105]

An angle of the second rotational axis 20J with respect to the first rotational axis 19J may be variable on a plane intersecting the Y-axis direction in which the fixing section 41 and the pressure-applying section 42 are opposed to each other in the fixing device 105. In one example, the angle of the second rotational axis 20J with respect to the first rotational axis 19J may be variable on the X-Z plane. The fixing device 105 may include a mechanism that adjusts an angle of the second rotational axis 20J with respect to the first rotational axis 19J viewed from the −Y direction. This allows for stable rotation driving of the fixing belt 43 and the pressure-applying belt 44 that are biased toward each other in the Y-axis direction with the medium in between. As a result, it is possible for the fixing device 105 to appropriately convey the medium for a long period.

The second rotational axis 20J and the first rotational axis 19J may often have a skew-line relationship in the fixing device 105 due to dimension accuracy or attachment position accuracy of each roller such as the fixing roller 19 in the fixing section 41 and dimension accuracy or attachment position accuracy of each roller such as the pressure-applying roller 20 in the pressure-applying section 42. As a result, the rotation operation of the fixing section 41 and the pressure-applying section 42 at the time of the fixing operation may sometimes move the fixing belt 43 and the pressure-applying belt 44 toward a left end or a right end of the fixing device 105 along the first rotational axis 19J and the second rotational axis 20J, respectively.

Figure 17:
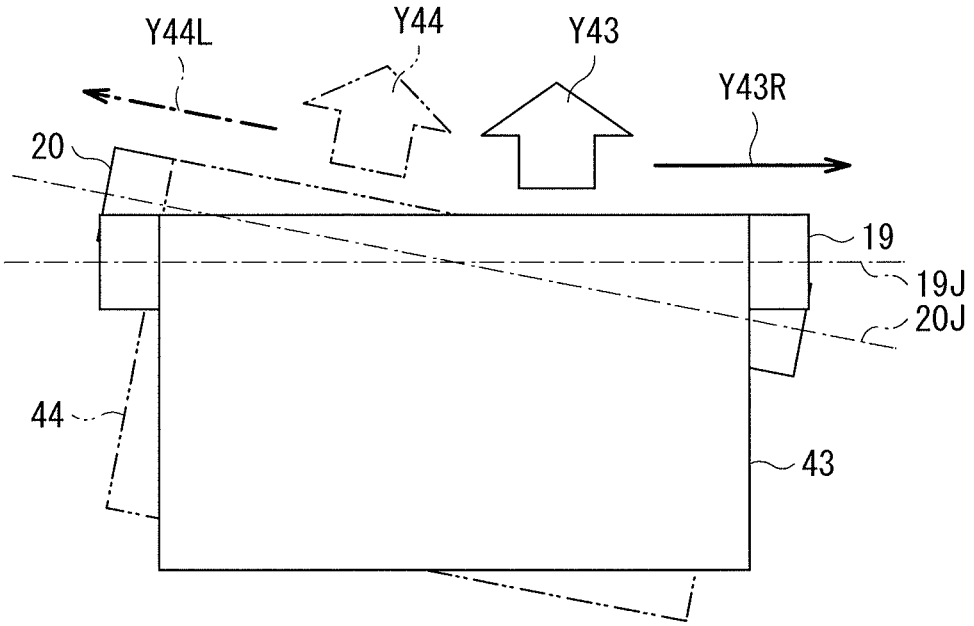
FIG. 17 is a first explanatory diagram schematically illustrating an example of a positional relationship between a fixing belt and a pressure-applying belt of the fixing device illustrated in FIG. 3.

To give an example, description is given, referring to a schematic diagram in FIG. 17, of a case where the second rotational axis 20J is inclined with respected to the first rotational axis 19J in a clockwise direction on a paper plane of FIG. 17. FIG. 17 is an explanatory diagram schematically illustrating an example of a positional relationship between the fixing belt 43 and the pressure-applying belt 44 in the fixing device 105 viewed from the −Y direction. In FIG. 17, a thick solid-line arrow indicates a direction of force Y43 applied by the fixing belt 43 to the pressure-applying belt 44 with the medium in between. A thick dashed-line arrow indicates a direction of force Y44 applied by the pressure-applying belt 44 to the fixing belt 43 with the medium in between. In this case, force in a rightward direction indicated by an arrow Y43R may act on the fixing belt 43 along the first rotational axis 19J. Force in a leftward direction indicated by an arrow Y44L may act on the pressure-applying belt 44 along the second rotational axis 20J. One reason for this is a difference between a direction of the force Y43 deriving from the fixing belt 43 and a direction of the force Y44 deriving from the pressure-applying belt 44. That is, one reason is that the force Y44 deriving from the pressure-applying belt 44 may include a component in the right direction Y43R along the first rotational axis 19J while the force Y43 deriving from the fixing belt 43 includes a component in the left direction Y44L along the second rotational axis 20J. In this case, continuous rotation operation of the fixing belt 43 may gradually move the fixing belt 43 in the rightward direction Y43R, finally causing a right edge of the fixing belt 43 to come into contact with the guide 49 in the fixing device 105. Similarly, continuous rotation operation of the pressure-applying belt 44 may gradually move the pressure-applying belt 44 in the leftward direction Y44L, finally causing a left edge of the pressure-applying belt 44 to come into contact with the guide 54 in the fixing device 105. As a result, driving torque required for rotation of each of the fixing belt 43 and the pressure-applying belt 44 may increase.

To address this, the eccentric cam 108 may rotate around the cam rotational axis 108J in the fixing device 105 according to the example embodiment. This adjusts the angle of the second rotational axis 20J with respect to the first rotational axis 19J, suppressing the movement of the fixing belt 43 and the pressure-applying belt 44.

Figure 18:
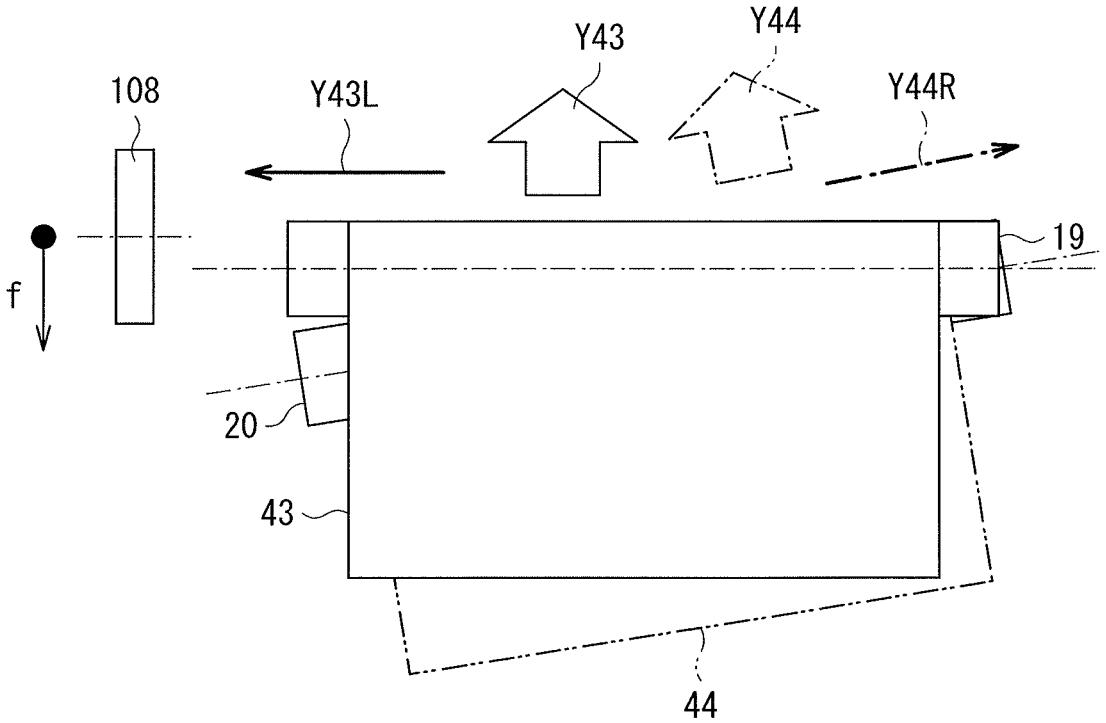
FIG. 18 is a second explanatory diagram schematically illustrating an example of the positional relationship between the fixing belt and the pressure-applying belt of the fixing device illustrated in FIG. 3.

For example, as illustrated in FIG. 10B, the eccentric cam 108 may be rotated by about 45° in the leftward direction on the paper plane indicated by the arrow "f", from the posture at the reference position illustrated in FIG. 10A. As illustrated in FIG. 18, this may shift a left end of the pressure-applying roller 20 in the upstream direction, i.e., the −Z direction, inclining the second rotational axis 20J counterclockwise on the paper plane with respect to the first rotational axis 19J. In this case, force in the leftward direction indicated by an arrow Y43L may act on the fixing belt 43 along the first rotational axis 19J, and force in a rightward direction indicated by an arrow Y44R may act on the pressure-applying belt 44 along the second rotational axis 20J. It is to be noted that FIG. 18 is an explanatory diagram schematically illustrating a positional relationship between the fixing belt 43 and the pressure-applying belt 44 in a case where the eccentric cam 108 has the posture illustrated in FIG. 10B.

Figure 19:
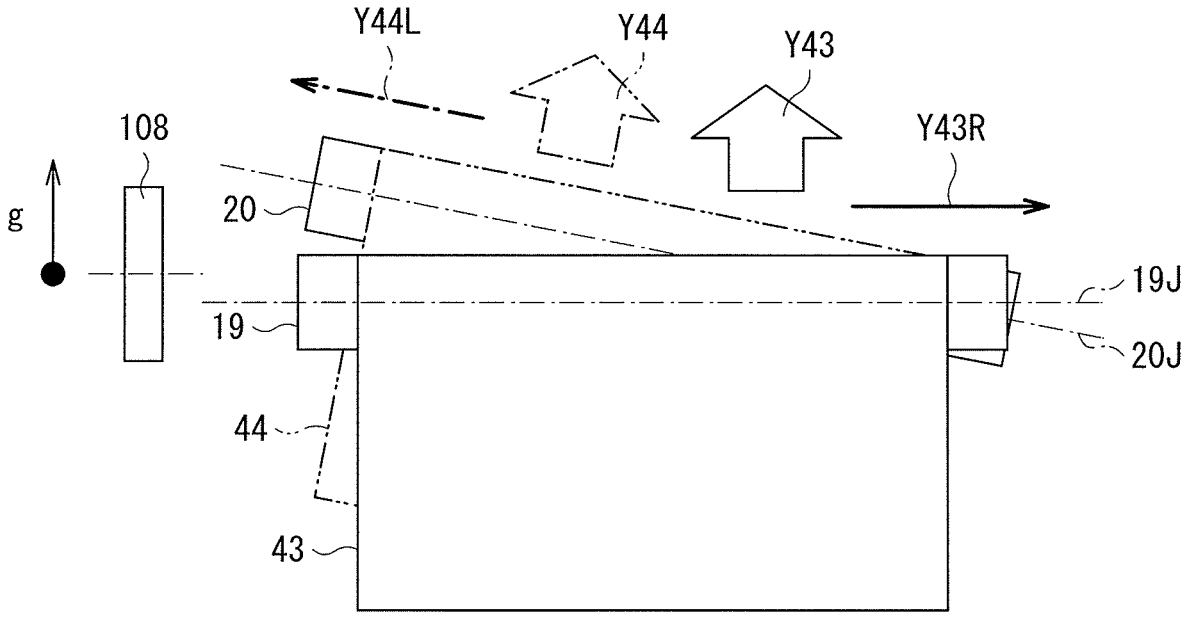
FIG. 19 is a third explanatory diagram schematically illustrating an example of the positional relationship between the fixing belt and the pressure-applying belt of the fixing device illustrated in FIG. 3.

In contrast, for example, as illustrated in FIG. 10C, the eccentric cam 108 may be rotated by about 45° in a rightward direction on the paper plane indicated by the arrow "g", from the posture at the reference position illustrated in FIG. 10A. As illustrated in FIG. 19, this may shift the left end of the pressure-applying roller 20 in the downstream direction, i.e., the +Z direction, inclining the second rotational axis 20J clockwise on the paper plane with respect to the first rotational axis 19J. In this case, force in a rightward direction indicated by an arrow Y43R may act on the fixing belt 43 along the first rotational axis 19J, and force in a leftward direction indicated by an arrow Y44L may act on the pressure-applying belt 44 along the second rotational axis 20J. It is to be noted that FIG. 19 is an explanatory diagram schematically illustrating a positional relationship between the fixing belt 43 and the pressure-applying belt 44 in a case where the eccentric cam 108 has the posture illustrated in FIG. 10C.

Figure 20:
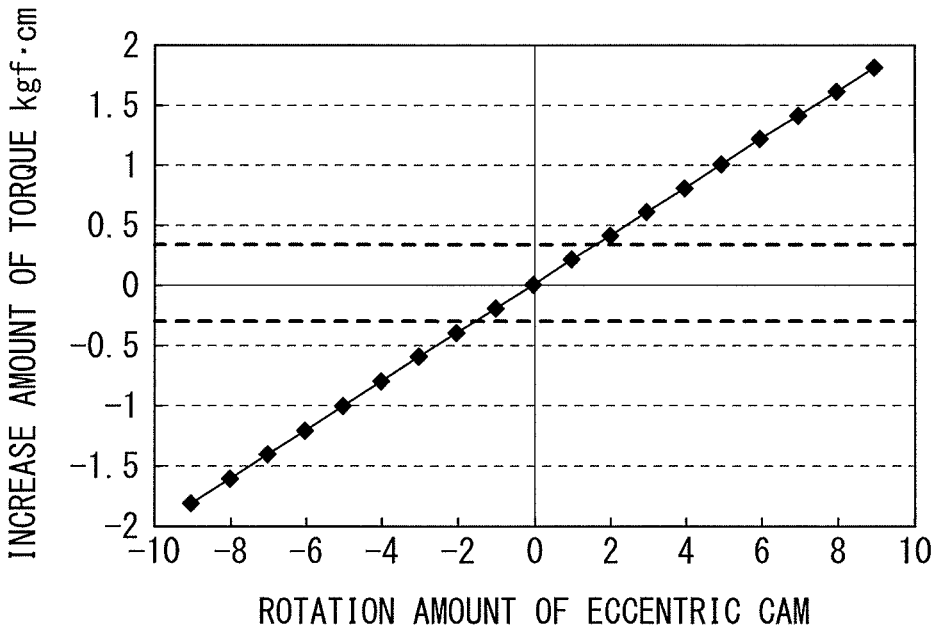
FIG. 20 is a characteristic diagram illustrating an example of a relationship between a rotational angle of the eccentric cam (a rotation amount of the eccentric cam based on the number of slots as a unit) and an increased amount of driving torque required for rotation of the fixing belt.

For example, as illustrated in FIG. 20, a rotational angle of the eccentric cam 108 may be in proportion to an increase amount of the driving torque required for the rotation of the fixing belt 43 in the fixing device 105 according to the present example embodiment. The rotational angle of the eccentric cam 108 may correspond to a rotation amount of the eccentric cam 108 based on the number of the slots 112 as a unit. FIG. 20 is a characteristic diagram illustrating a relationship between the rotational angle of the eccentric cam 108, e.g., the rotation amount of the eccentric cam 108 based on the number of the slots 112 as a unit, and the increase amount of the driving torque required for the rotation of the fixing belt 43. For example, rotation of the eccentric cam 108 corresponding to a single slot 112 may move the left end of the pressure-applying roller 20 in the Z-axis direction by 0.1 mm. The increase amount of the driving torque may refer to an amount of an increase from a minimum value of the driving torque for the fixing belt 43 to a value of the driving torque for the fixing belt 43 at a time when the eccentric cam 108 is at a position rotated from the reference position (0) by any rotation amount. Accordingly, the greater the angle of the second rotational axis 20J with respect to the first rotational axis 19J becomes, the greater the driving torque for the fixing belt 43 becomes.

In the fixing device 105 according to one example embodiment, the rotation amount of the eccentric cam 108 may be selected so that the force in the direction Y43R acting on the fixing belt 43 and the force in the direction Y43L acting on the fixing belt 43 balance with each other while the force in the direction Y44R acting on the pressure-applying belt 44 and the force in the direction Y44L acting on the pressure-applying belt 44 balance with each other. In this case, an appropriate one of the slots 112 may be selected and the projection 115 may be fit into the selected slot 112, which may be fixed by the locking member 114. This allows the fixing device 105 to continuously perform stable rotation operation of the fixing belt 43 and the pressure-applying belt 44 without bringing the fixing belt 43 and the pressure-applying belt 44 in excessive contact with the guides 49 and 54, respectively. As a result, degradation of the fixing belt 43 due to contact with the guide 49 and degradation of the pressure-applying belt 44 due to contact with the guide 54 are suppressed, achieving superior stability for a longer period.

Figure 21:
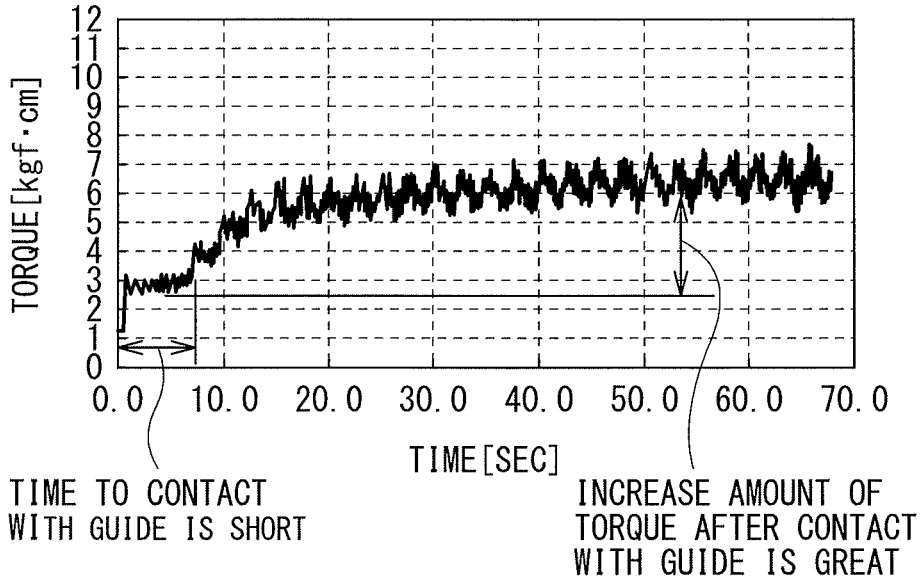
FIG. 21 is a characteristic diagram illustrating an example of variation over time of driving torque for the fixing belt in a case where an inclination of a rotational axis of a fixing roller with respect to a rotational axis of a pressure-applying roller is not adjusted in the fixing device illustrated in FIG. 3.

In a case where the angle of the second rotational axis 20J with respect to the first rotational axis 19J is not appropriately adjusted in the fixing device 105, the fixing belt 43 and the pressure-applying belt 44 may be shifted to one side in accordance with the rotation operation of the fixing belt 43 and the pressure-applying belt 44. In this case, as illustrated in FIG. 21, the driving torque for the fixing belt 43 may increase due to the contact between the fixing belt 43 and the guide 49 or the driving torque for the pressure-applying belt 44 may increase due to the contact between the pressure-applying belt 44 and the guide 54 after a predetermined time elapses. In FIG. 21, a horizontal axis indicates an elapsed time (second) and a vertical axis indicates the driving torque (kgf·cm) for the fixing belt 43.

Figure 22:
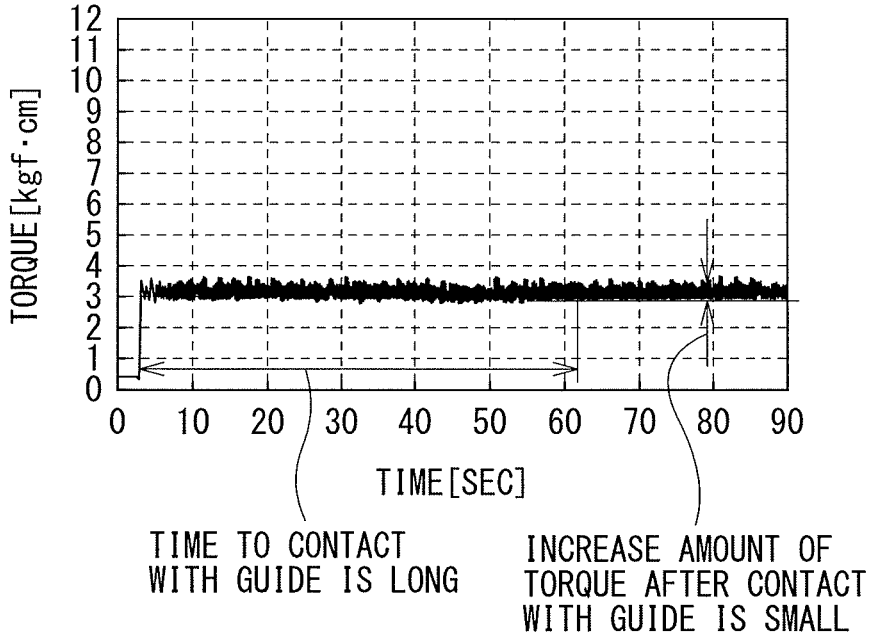
FIG. 22 is a characteristic diagram illustrating an example of variation over time of the driving torque for the fixing belt in the case where the inclination of the rotational axis of the fixing roller with respect to the rotational axis of the pressure-applying roller is not adjusted in the fixing device illustrated in FIG. 3.

In a case where the angle of the second rotational axis 20J with respect to the first rotational axis 19J is appropriately adjusted in the fixing device 105, the fixing belt 43 and the pressure-applying belt 44 may be prevented from being shifted to one side in accordance with the rotation operation of the fixing belt 43 and the pressure-applying belt 44. In this case, as illustrated in FIG. 22, the driving torque for the fixing belt 43 may not increase due to the contact between the fixing belt 43 and the guide 49 or the driving torque for the pressure-applying belt 44 may not increase due to the contact between the pressure-applying belt 44 and the guide 54 even after a predetermined time elapses. This allows for reduction in power consumption. In FIG. 22, a horizontal axis indicates an elapsed time (second) and a vertical axis indicates the driving torque (kgf·cm) for the fixing belt 43.

[C. Operation of Fixing Device 105]

Operation of the fixing device 105 may have three modes, that is, a usual printing mode (a usual pressure mode), a special printing mode (a reduced pressure mode), and a standby mode (a separated-away mode), based on the postures, i.e., the rotational positions, of the first cams L1 and R1 and the second cams L2 and R2.

[Usual Printing Mode]

The usual printing mode (the usual pressure mode) is described below referring to FIGS. 23A and 23B. The print controller 700 may determine a type of the medium, and when the medium is a usual medium, may perform the following operation. The usual medium may be other than a special medium. Non-limiting examples of the special medium may include an envelope, a thin sheet of paper, a sheet of weighing paper, and any other medium that easily wrinkles. For example, the print controller 700 may cause the fixing controller 790 to drive the cam motor 794, causing the first cam gears LG1 and RG1 and the second cam gears LG2 and RG2 to rotate in association with each other and thereby keeping the first cams L1 and R1 and the second cams L2 and R2 in the postures illustrated in FIGS. 11A and 11B. In other words, the print controller 700 may so stop the rotation of the first cam gears LG1 and RG1 and the second cam gears LG2 and RG2 that the positions of the first cam gears LG1 and RG1 and the second cam gears LG2 and RG2 cause the contact protruding plates 93L, 93R, 94L, and 94R to be respectively in contact with the cam surface AL1 of the first cam L1, the cam surface AR1 of the first cam R1, the cam surface AL2 of the second cam L2, and the cam surface AR2 of the second cam R2. This may keep the contact protruding plates 93L and 93R to be positioned at the distance A from the axis 87J and keep the contact protruding plates 94L and 94R to be positioned at the distance A from the axis 89J, keeping the middle chassis 65 at the highest position among the three modes. Further, the holding arms 68L and 68R may be biased by the first biasing members 74L and 74R and thereby pivot upward around the rotational shafts 72L and 72R, respectively, biasing the pressure-applying roller 20 toward the fixing roller 19 with the pressure-applying belt 44 and the fixing belt 43 in between. At this time, the holding arms 68L and 68R may extend in a direction approximately matching the Z-axis direction while the upper ends of the stoppers 73L and 73R of the holding arms 68L and 68R are separated away from the lower ends of the stopping portions 75L and 75R of the middle chassis 65, respectively. The holding arms 70L and 70R may be biased by the second biasing members 78L and 78R and thereby pivot upward around the rotational shafts 72L and 72R, respectively, biasing the flat portion 56T of the pressure-applying pad 56 toward the flat portion 51T of the fixing pad 51 with the pressure-applying belt 44 and the fixing belt 43 in between. As a result, the nip portion N may be provided at the boundary between the pressure-applying belt 44 and the fixing belt 43 as illustrated in FIG. 5C.

At this time, gaps may be present between the contact surfaces 84L and 84R and the edges 97L and 97R of the through holes 83L and 83R in the holding arms 68L and 68R, respectively. This allows the pressure-applying pad 56 to so rotate around the rotational axis 56J that the flat portion 56T has a posture approximately parallel to the flat portion 51T in accordance with the posture of the fixing pad 51. As a result, so-called uneven contact where only a portion of the nip portion N in the Z-axis direction is in a contact state becomes avoidable, achieving a highly-uniform and stable nip pressure across the entire nip portion N. Further, variation in nip pressure in the nip portion N may be further reduced when the center position of the flat portion 51T of the fixing pad 51 and the center position of the flat portion 56T of the pressure-applying pad 56 approximately match each other in the Z-axis direction.

[Special Printing Mode]

The special printing mode (the reduced pressure mode) is described next referring to FIGS. 24A and 24B. In the special printing mode, the fixing operation may be performed on the special medium such as an envelope, a thin sheet of paper, a sheet of weighing paper, or any other medium that easily wrinkles. The fixing operation in the special printing mode may be performed with a nip pressure lower than that in the usual printing mode. The print controller 700 may perform the following operation when the print controller 700 determines the medium as the special medium. For example, the print controller 700 may cause the fixing controller 790 to drive the cam motor 794, causing the first cam gears LG1 and RG1 and the second cam gears LG2 and RG2 to rotate in association with each other and thereby keeping the first cams L1 and R1 and the second cams L2 and R2 in the postures illustrated in FIG. 16A. In other words, the print controller 700 may so stop the rotation of the first cam gears LG1 and RG1 and the second cam gears LG2 and RG2 that the positions of the first cam gears LG1 and RG1 and the second cam gears LG2 and RG2 cause the contact protruding plates 93L, 93R, 94L, and 94R to be respectively in contact with the cam surface BL1 of the first cam L1, the cam surface BR1 of the first cam R1, the cam surface BL2 of the second cam L2, and the cam surface BR2 of the second cam R2. This may keep the contact protruding plates 93L and 93R to be positioned at the distance B from the axis 87J and keep the contact protruding plates 94L and 94R to be positioned at the distance B from the axis 89J, keeping the middle chassis 65 at a position slightly lower than that in the usual printing mode in the Y-axis direction. Accordingly, as illustrated in FIG. 24B, the holding arms 68L and 68R may be biased by the first biasing members 74L and 74R and thereby pivot upward around the rotational shafts 72L and 72R, respectively, by rotational angles greater than those in the usual printing mode. At this time, the holding arms 68L and 68R may be slightly inclined compared with the state of the holding arms 68L and 68R in the usual printing mode, causing the upper ends of the stoppers 73L and 73R of the holding arms 68L and 68R to be in contact with the lower ends of the stopping portions 75L and 75R of the middle chassis 65, respectively. Therefore, the pressure-applying roller 20 supported by the holding arms 68L and 68R may be biased toward the fixing roller 19 with the pressure-applying belt 44 and the fixing belt 43 in between by force smaller than that in the usual printing mode.

Gaps may be present between the contact surfaces 84L and 84R and the edges 97L and 97R of the through holes 83L and 83R in the holding arms 68L and 68R, respectively, also in the special printing mode as in the usual printing mode. This allows the pressure-applying pad 56 to so rotate around the rotational axis 56J that the flat portion 56T has a posture approximately parallel to the flat portion 51T in accordance with the posture of the fixing pad 51. Accordingly, the holding arms 70L and 70R may be biased by the second biasing members 78L and 78R and thereby pivot upward around the rotational shafts 72L and 72R, respectively, biasing the flat portion 56T of the pressure-applying pad 56 toward the flat portion 51T of the fixing pad 51 with the pressure-applying belt 44 and the fixing belt 43 in between. In the special printing mode, the middle chassis 65 may be kept at the position slightly lower than that in the usual printing mode in the Y-axis direction, causing the holding arms 70L and 70R to be biased by the second biasing members 78L and 78R and thereby pivot upward around the rotational shafts 72L and 72R, respectively, by rotational angles greater than those in the usual printing mode. The biasing force of the second biasing members 78L and 78R may be therefore smaller in the special printing mode than that in the usual printing mode. Accordingly, the pressure-applying pad 56 may be biased toward the fixing pad 51 by force smaller in the special printing mode than that in the usual printing mode.

As a result, in the special printing mode, although the nip portion N is provided at the boundary between the pressure-applying belt 44 and the fixing belt 43, the force that causes the contact between the pressure-applying belt 44 and the fixing belt 43 in the nip portion N is smaller than that in the usual printing mode. The pressure-applying pad 56 may be allowed to so rotate around the rotational axis 56J that the flat portion 56T has a posture approximately parallel to the flat portion 51T in accordance with the posture of the fixing pad 51, also in the special printing mode. As a result, so-called uneven contact where only a portion of the nip portion N in the Z-axis direction is in a contact state becomes avoidable, achieving a highly-uniform and stable nip pressure across the entire nip portion N.

[Standby Mode]

The standby mode (the separated-away mode) is described next referring to FIGS. 25A and 25B. In the standby mode, the fixing operation may not be performed on the medium. The print controller 700 may perform the following operation when the print controller 700 determines not to perform the fixing operation on the medium. For example, the print controller 700 may cause the fixing controller 790 to drive the cam motor 794, causing the first cam gears LG1 and RG1 and the second cam gears LG2 and RG2 to rotate in association with each other and thereby keeping the first cams L1 and R1 and the second cams L2 and R2 in the postures illustrated in FIG. 16B. In other words, the print controller 700 may so stop the rotation of the first cam gears LG1 and RG1 and the second cam gears LG2 and RG2 that the positions of the first cam gears LG1 and RG1 and the second cam gears LG2 and RG2 cause the contact protruding plates 93L, 93R, 94L, and 94R to be respectively in contact with the cam surface CL1 of the first cam L1, the cam surface CR1 of the first cam R1, the cam surface CL2 of the second cam L2, and the cam surface CR2 of the second cam R2. This may keep the contact protruding plates 93L and 93R to be positioned at the distance C from the axis 87J and keep the contact protruding plates 94L and 94R to be positioned at the distance C from the axis 89J, keeping the middle chassis 65 at a position further lower than that in the special printing mode in the Y-axis direction. Accordingly, as illustrated in FIG. 25B, the upper ends of the stoppers 73L and 73R of the holding arms 68L and 68R may be in contact with the lower ends of the stopping portions 75L and 75R of the middle chassis 65, respectively, in the standby mode as in the special printing mode. The height positions of the rotational shafts 72L and 72R may be further lower in the standby mode than in the special printing mode, further increasing inclination angles of the holding arms 68L and 68R. Therefore, the pressure-applying roller 20 supported by the holding arms 68L and 68R may be kept at a position separated away from the fixing roller 19 without biasing the fixing roller 19.

The holding arms 70L and 70R may be biased by the second biasing members 78L and 78R and thereby pivot upward around the rotational shafts 72L and 72R, respectively. In the standby mode, the inclination angles of the holding arms 68L and 68R may be greater than those in the special printing mode and the usual printing mode, as described above. Therefore, unlike in the special printing mode and the usual printing mode, the contact surfaces 84L and 84R of the protrusions 56L and 56R may come into contact with the edges 97L and 97R of the through holes 83L and 83R in the holding arms 68L and 68R, respectively, in the standby mode, limiting the rotational angles of the holding arms 70L and 70R. As a result, the pressure-applying belt 44 and the fixing belt 43 may be separated away from each other without providing the nip portion N at the boundary between the pressure-applying belt 44 and the fixing belt 43, causing the pressure-applying belt 44 and the fixing belt 43 to be separated from each other.

[D. Example Effects]

As described above, according to the fixing device 105 of the example embodiment, the angle of the second rotational axis 20J with respect to the first rotational axis 19J may be variable in the X-Z plane intersecting the Y-axis direction in which the fixing section 41 and the pressure-applying section 42 are opposed to each other. Accordingly, appropriately adjusting the angle of the second rotational axis 20J with respect to the first rotational axis 19J suppresses the movement of the fixing belt 43 along the first rotational axis 19J accompanying the rotation of the fixing roller 19 and suppresses the movement of the pressure-applying belt 44 along the second rotational axis 20J accompanying the rotation of the pressure-applying roller 20 in the fixing device 105. This contributes to avoidance of degradation or damaging of the fixing belt 43 and the pressure-applying belt 44, making the fixing device 105 and the image forming apparatus 1 provided with the fixing device 105 suitable for achieving a high-quality image for a longer period.

Moreover, according to the fixing device 105 of the example embodiment, the angle of the second rotational axis 20J with respect to the first rotational axis 19J may be adjusted by the rotation of the eccentric cam 108 including the cam surface having the diameter 108D that is substantially uniform in the plane perpendicular to the cam rotational axis 108J. This allows the rotation amount of the eccentric cam 108 to be in proportion to the moving amount of the left end of the pressure-applying roller 20 in the Z-axis direction, i.e., the angle of the second rotational axis 20J with respect to the first rotational axis 19J. This makes it easier to adjust the angle of the second rotational axis 20J with respect to the first rotational axis 19J.

Moreover, according to the fixing device 105 of the example embodiment, the upper chassis 59 may include the fitted member 106L having the groove 107L to which the cam surface 109 is to be fitted, and the locking member 114 keeping the rotational angle of the eccentric cam 108 with respect to the groove 107L may be further provided. This contributes to stably keeping the once-adjusted angle of the second rotational axis 20J with respect to the first rotational axis 19J, avoiding the uneven contact of the fixing belt 43 and the pressure-applying belt 44 for a longer period. As a result, it is possible to appropriately convey the medium for a longer period according to the fixing device 105 of the example embodiment.

Moreover, in the fixing device 105 of the example embodiment, controlling of the postures of the first cams L1 and R1 and the second cams L2 and R2 allows for transition between the usual printing mode and the special printing mode both performing printing on the medium and the standby mode not performing printing on the medium. The pressure-applying pad 56 may be supported by the holding arm 70 while the posture of the pressure-applying pad 56 is variable with respect to the holding arm 70 in the usual printing mode and the special printing mode in the fixing device 105. In other words, the pressure-applying pad 56 may have a posture that is variable with respect to the pressure-applying roller 20 and also with respect to both of the fixing belt 43 and the fixing pad 51. For example, the pressure-applying pad 56 may be allowed to so rotate around the rotational axis 56J that the flat portion 56T has a posture approximately parallel to the flat portion 51T in accordance with the posture of the fixing pad 51. As a result, so-called uneven contact where only a portion of the nip portion N in the Z-axis direction is in a contact state becomes avoidable, achieving a highly-uniform and stable nip pressure across the entire nip portion N. Therefore, according to the image forming apparatus 1 provided with the fixing device 105 according to the example embodiment, the fixing process with a stable nip pressure is allowed, preventing an issue such as a decrease in fixing rate or an image defect. This contributes to achieving a higher-quality image.

2. Modification Examples

One embodiment of the technology has been described above referring to some example embodiments; however, the technology is not limited thereto and may be modified in a variety of ways. For example, description has been given above of the example embodiment of the image forming apparatus forming a color image; however, the technology is not limited thereto. In one example embodiment, the image forming apparatus may transfer, for example, only a black toner image to form a monochrome image. Further, description has been given above of the example embodiment of the image forming apparatus of a primary transfer method, i.e., a direct transfer method; however, the technology is not limited thereto. One example embodiment of the technology is applicable to a secondary transfer method.

Further, description has been given above of the example embodiment where the first rotation section may include the first belt and the second rotation section may include the second belt; however, the technology is not limited thereto. In one example embodiment, the first rotation section may include the first belt but the second rotation section may not include the second belt. Reversely, the first rotation section may not include the first belt and the second rotation section may include the second belt. For example, one embodiment of the technology is applicable to a specific but non-limiting example where the fixing section 41 includes the fixing belt 43 but the pressure-applying section 42 does not include the pressure-applying belt 44 and the pressure-applying roller 20 and the fixing belt 43 provide a nip portion. One embodiment of the technology is also applicable to a specific but non-limiting example where the fixing section 41 does not include the fixing belt 43 but the pressure-applying section 42 includes the pressure-applying belt 44 and the fixing roller 19 and the pressure-applying belt 44 provide a nip portion.

Moreover, description has been given above of the example embodiment where the angle of the second rotational axis with respect to the first rotational axis may be adjusted with the use of the eccentric cam; however, the technology is not limited thereto.

Moreover, description has been given above of the example embodiment where the eccentric cam 108 may have the plurality of slots 112 to be engaged with the projections 115 and the eccentric cam 108 may be fixed by the locking member 114 at a rotational angle set in a stepwise manner; however, the technology is not limited thereto. In one example embodiment, the rotation of the eccentric cam 108 may be controlled by bringing a contacting member in contact with a portion of the eccentric cam 108. This allows for keeping the eccentric cam 108 in a posture with any rotational angle in a continuous manner.

Moreover, description has been given above of the example embodiment where two pairs of cams are disposed side by side in the Z-axis direction corresponding to the first direction while each pair of cams is disposed at two ends in the X-axis direction; however, the technology is not limited thereto. In one example embodiment, only a single cam or a single pair of cams may be provided. In another example embodiment, three or more pairs of cams may be provided. The upward and downward operation of the middle section 46 may be, however, more stable in the case with two pairs of cams than in the case with only a single cam or only a single pair of cams. Further, the case with two pairs of cams may be more advantageous in simplification of structure than the case with three or more pairs of cams.

Moreover, description has been given above of the example embodiment where the upper chassis 59 may have the groove 107L and the eccentric cam 108 may be provided at the end of the middle chassis 65; however, the technology is not limited thereto. In one example embodiment, the middle chassis 65 may have a groove and the eccentric cam 108 may be provided at an end of the upper chassis 59.

Moreover, description has been given above of the example embodiment where the fixing device 105 may have three operation modes, that is, the usual printing mode (the usual pressure mode), the special printing mode (the reduced pressure mode), and the standby mode (the separated-away mode); however, the technology is not limited thereto. In one example embodiment, the contact force in the reduced pressure mode may be classified more finely. For example, another mode may be provided in addition in which the fixing pad 51 and the pressure-applying pad 56 are separated away from each other while the fixing roller 19 and the pressure-applying roller 20 are in contact with each other.

Moreover, description has been given above of the example embodiment where the LED head having a light-emitting diode as a light source may be used as the exposure device; however, the technology is not limited thereto. In one example embodiment, an exposure device having any other light source such as a laser element may be provided.

Moreover, description has been given above of the example embodiment of the image forming apparatus performing printing as a specific but non-limiting example of the "image forming apparatus" in one embodiment of the technology; however, this is non-limiting. For example, one embodiment of the technology may applicable also to an image forming apparatus serving as a multi-function peripheral performing another operation such as scanning or faxing in addition to printing.

Furthermore, the technology encompasses any possible combination of some or all of the various embodiments and the modifications described herein and incorporated herein. It is possible to achieve at least the following configurations from the above-described example embodiments of the technology.

(1)

A fixing device including:

a first rotation section that includes a first rotating member and a first belt, the first rotating member being rotatable about a first rotational axis, the first belt being caused to rotate by rotation of the first rotating member; and a second rotation section that includes a second rotating member, the second rotation section being opposed to the first rotation section in a first direction and allowing a medium to be sandwiched between the first rotation section and the second rotation section, the second rotating member being rotatable about a second rotational axis, the second rotation section being disposed allowing an angle of the second rotational axis with respect to the first rotational axis viewed from the first direction to be variable.

(2)

The fixing device according to (1), in which the second rotation section further includes a second belt, the second belt being caused to rotate by rotation of the second rotating member.

(3)

The fixing device according to (1) or (2), further including:

a first supporting member that rotatably supports the first rotating member;

a second supporting member that rotatably supports the second rotating member; and an eccentric cam that is rotatably attached to the first supporting member or the second supporting member, the eccentric cam rotating around a cam rotational axis and thereby varying relative positions of the first supporting member and the second supporting member with respect to each other.

According to the fixing device and the image forming apparatus of one embodiment of the technology, the movement of the first belt along the first rotational axis accompanying the rotation of the first rotating member is suppressed, avoiding degradation or damaging of the first belt. The fixing device and the image forming apparatus according to one embodiment of the technology are therefore suitable for achieving a high-quality image for a longer period.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A fixing device comprising:

a first rotation section that includes a first rotating member and a first belt, the first rotating member being rotatable about a first rotational axis, the first belt being caused to rotate by rotation of the first rotating member; and a second rotation section that includes a second rotating member, the second rotation section being opposed to the first rotation section in a first direction and allowing a medium to be sandwiched between the first rotation section and the second rotation section, the second rotating member being rotatable about a second rotational axis, the second rotation section being disposed allowing an angle of the second rotational axis with respect to the first rotational axis viewed from the first direction to be variable.

2. The fixing device according to claim 1, wherein the second rotation section further includes a second belt, the second belt being caused to rotate by rotation of the second rotating member.

3. The fixing device according to claim 1, further comprising:

a first supporting member that rotatably supports the first rotating member;

a second supporting member that rotatably supports the second rotating member; and an eccentric cam that is rotatably attached to the first supporting member or the second supporting member, the eccentric cam rotating around a cam rotational axis and thereby varying relative positions of the first supporting member and the second supporting member with respect to each other.

4. The fixing device according to claim 3, wherein the eccentric cam includes a cam surface, the cam surface having a diameter that is substantially uniform in a plane perpendicular to the cam rotational axis, the first supporting member or the second supporting member includes an engaging portion that engages with the cam surface, and the engaging portion includes a pair of engaging surfaces, the engaging surfaces being opposed to each other with the cam surface interposed in between.

5. The fixing device according to claim 3, wherein the first supporting member includes an engaging portion that engages with a cam surface of the eccentric cam, and the eccentric cam is provided at an end, of the second supporting member, extending along the second rotational axis.

6. The fixing device according to claim 5, further comprising a rotation controlling member that keeps a rotational angle of the eccentric cam with respect to the engaging portion.

7. The fixing device according to claim 6, wherein the eccentric cam includes a plurality of first projections or a plurality of first recesses, the first projections being provided in a rotation direction of the eccentric cam, the first recesses being provided in the rotation direction of the eccentric cam, the eccentric cam being rotatably attached to a shaft fixed to the first supporting member or the second supporting member, the shaft includes a second projection or a second recess, and the rotation controlling member includes a third recess or a third projection and includes a fourth recess or a fourth projection, the third recess being to engage with any of the first projections, the third projection being to engage with any of the first recesses, the fourth recess being to engage with the second projection, the fourth projection being to engage with the second recess.

8. The fixing device according to claim 3, wherein the second supporting member includes an engaging portion that engages with a cam surface of the eccentric cam, and the eccentric cam is provided at an end, of the first supporting member, extending along the first rotational axis.

9. The fixing device according to claim 8, further comprising a rotation controlling member that keeps a rotational angle of the eccentric cam with respect to the engaging portion.

10. The fixing device according to claim 9, wherein the eccentric cam includes a plurality of first projections or a plurality of first recesses, the first projections being provided in a rotation direction of the eccentric cam, the first recesses being provided in the rotation direction of the eccentric cam, the eccentric cam being rotatably attached to a shaft fixed to the first supporting member or the second supporting member, the shaft includes a second projection or a second recess, and the rotation controlling member includes a third recess or a third projection and includes a fourth recess or a fourth projection, the third recess being to engage with any of the first projections, the third projection being to engage with any of the first recesses, the fourth recess being to engage with the second projection, the fourth projection being to engage with the second recess.

11. The fixing device according to claim 1, wherein the first rotation section and the second rotation section convey the medium in a direction intersecting the first direction.

12. An image forming apparatus comprising a fixing device, the fixing device including:

a first rotation section that includes a first rotating member and a first belt, the first rotating member being rotatable about a first rotational axis, the first belt being caused to rotate by rotation of the first rotating member; and a second rotation section that includes a second rotating member, the second rotation section being opposed to the first rotation section in a first direction and allowing a medium to be sandwiched between the first rotation section and the second rotation section, the second rotating member being rotatable about a second rotational axis, the second rotation section being disposed allowing an angle of the second rotational axis with respect to the first rotational axis viewed from the first direction to be variable.

* * * * *